US009474923B2

(12) United States Patent
Davenport

(10) Patent No.: US 9,474,923 B2
(45) Date of Patent: Oct. 25, 2016

(54) MULTI-PURPOSE EXERCISE BENCH WITH VERSATILE RESISTANCE ACCESSORY

(71) Applicant: Damian Devore Davenport, Harrisburg, PA (US)

(72) Inventor: Damian Devore Davenport, Harrisburg, PA (US)

( * ) Notice: Subject to any disclaimer, the term of this patent is extended or adjusted under 35 U.S.C. 154(b) by 43 days.

(21) Appl. No.: 14/450,991

(22) Filed: Aug. 4, 2014

(65) Prior Publication Data

US 2015/0038304 A1 Feb. 5, 2015

Related U.S. Application Data

(60) Provisional application No. 61/861,578, filed on Aug. 2, 2013.

(51) Int. Cl.
*A63B 21/02* (2006.01)
*A63B 21/04* (2006.01)
(Continued)

(52) U.S. Cl.
CPC ..... *A63B 21/0442* (2013.01); *A63B 21/00047* (2013.01); *A63B 21/00065* (2013.01); *A63B 21/0435* (2013.01); *A63B 21/0724* (2013.01); *A63B 21/4023* (2015.10); *A63B 21/4029* (2015.10); *A63B 21/4035* (2015.10); *A63B 22/203* (2013.01); *A63B 23/129* (2013.01); *A63B 23/1218* (2013.01); *A63B 23/1227* (2013.01); *A63B 23/1236* (2013.01); *A63B 23/1245* (2013.01); *A63B 23/1254* (2013.01);
(Continued)

(58) Field of Classification Search
CPC ..... A63B 21/00047; A63B 21/00061; A63B 21/00065; A63B 21/00069; A63B 21/02; A63B 21/023; A63B 21/025; A63B 21/04; A63B 21/0407; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/08; A63B 21/15; A63B 21/16; A63B 21/1609; A63B 21/4023; A63B 21/4029; A63B 21/0431; A63B 21/4035; A63B 21/4037; A63B 21/4043; A63B 23/12; A63B 21/1209; A63B 21/1218; A63B 21/1227; A63B 21/1236; A63B 21/1254; A63B 21/1263; A63B 21/1272; A63B 21/1281; A63B 21/129; A63B 21/14; A63B 2208/0204; A63B 2208/0209; A63B 2208/0214; A63B 2208/0223; A63B 2208/0228; A63B 2208/0252; A63B 2225/09; A63B 2225/10; A63B 2225/102; A63B 2225/105; A63B 2225/107; A63B 21/151; A63B 21/1245; A47C 9/002; A47C 9/005
See application file for complete search history.

(56) References Cited

U.S. PATENT DOCUMENTS 5,688,210 A * 11/1997 Chou ..... A63B 21/0552 482/121
6,152,866 A * 11/2000 Kuo ..... A63B 21/055 482/130
(Continued)

*Primary Examiner* — Oren Ginsberg
*Assistant Examiner* — Gary D Urbiel Goldner
(74) *Attorney, Agent, or Firm* — Saul Ewing LLP

(57) ABSTRACT

A multi-purpose exercise bench having a versatile resistance accessory configurable for use to provide weight-training resistance in a variety of exercises is provided. A multi-purpose exercise bench comprises: an elongated frame configured to rest on a flat floor in a stable manner; a lower seat portion supported on the frame; a resistance accessory mounted to the frame, the resistance accessory comprising: a pad movably mounted to the frame to be movable between a first position and a second position; a locking mechanism operable to lock the pad in either of the first position and the second position; and a plurality of resistance bands attached to the pad.

22 Claims, 23 Drawing Sheets

(51) Int. Cl.

| | |
|---|---|
| ***A63B 21/00*** | (2006.01) |
| ***A63B 21/072*** | (2006.01) |
| ***A63B 22/20*** | (2006.01) |
| ***A63B 23/12*** | (2006.01) |
| ***A63B 23/14*** | (2006.01) |

(52) U.S. Cl.
CPC ..... *A63B 23/1263* (2013.01); *A63B 23/1272* (2013.01); *A63B 23/1281* (2013.01); *A63B 23/14* (2013.01)

(56) References Cited

U.S. PATENT DOCUMENTS

| | | | | |
|---|---|---|---|---|
| 6,634,998 | B2 * | 10/2003 | Siaperas | A63B 21/04 482/123 |
| 6,887,190 | B1 * | 5/2005 | Azari | A63B 21/04 482/123 |
| 7,591,763 | B1 * | 9/2009 | Fucci | A63B 21/4029 482/121 |
| 7,946,969 | B1 * | 5/2011 | Friess | A63B 21/4033 482/123 |
| 8,029,425 | B2 * | 10/2011 | Bronston | A63B 21/02 482/123 |
| 8,241,190 | B2 * | 8/2012 | Van Straaten | A63B 23/1209 482/130 |
| 8,328,700 | B2 * | 12/2012 | Humble | A63B 21/025 242/375.1 |
| 8,403,818 | B1 * | 3/2013 | Wilkinson | A63B 21/00069 482/121 |
| 8,715,144 | B1 * | 5/2014 | Friess | A63B 21/4033 482/121 |
| 2004/0014570 | A1 * | 1/2004 | Centopani | A63B 21/0552 482/140 |
| 2006/0019806 | A1 * | 1/2006 | Mikulski | A63B 23/03541 482/121 |
| 2006/0128540 | A1 * | 6/2006 | Engle | A63B 21/04 482/123 |
| 2007/0010381 | A1 * | 1/2007 | Black | A63B 21/4029 482/130 |
| 2007/0129225 | A1 * | 6/2007 | Hammer | A63B 21/0552 482/129 |
| 2007/0270292 | A1 * | 11/2007 | Laney | A63B 21/4047 482/121 |
| 2008/0076641 | A1 * | 3/2008 | Sheehan | A63B 21/0552 482/92 |
| 2008/0090710 | A1 * | 4/2008 | Chung | A63B 21/4047 482/142 |
| 2008/0214369 | A1 * | 9/2008 | Mancini | A63B 21/04 482/121 |
| 2009/0247376 | A1 * | 10/2009 | Merrithew | A63B 21/00 482/121 |
| 2011/0065554 | A1 * | 3/2011 | Van Straaten | A63B 23/1209 482/130 |
| 2011/0098163 | A1 * | 4/2011 | Radzwill | A63B 21/078 482/142 |
| 2011/0251033 | A1 * | 10/2011 | Blancher | A63B 21/0442 482/123 |
| 2014/0005004 | A1 * | 1/2014 | Hall, Sr. | A63B 69/10 482/55 |

* cited by examiner

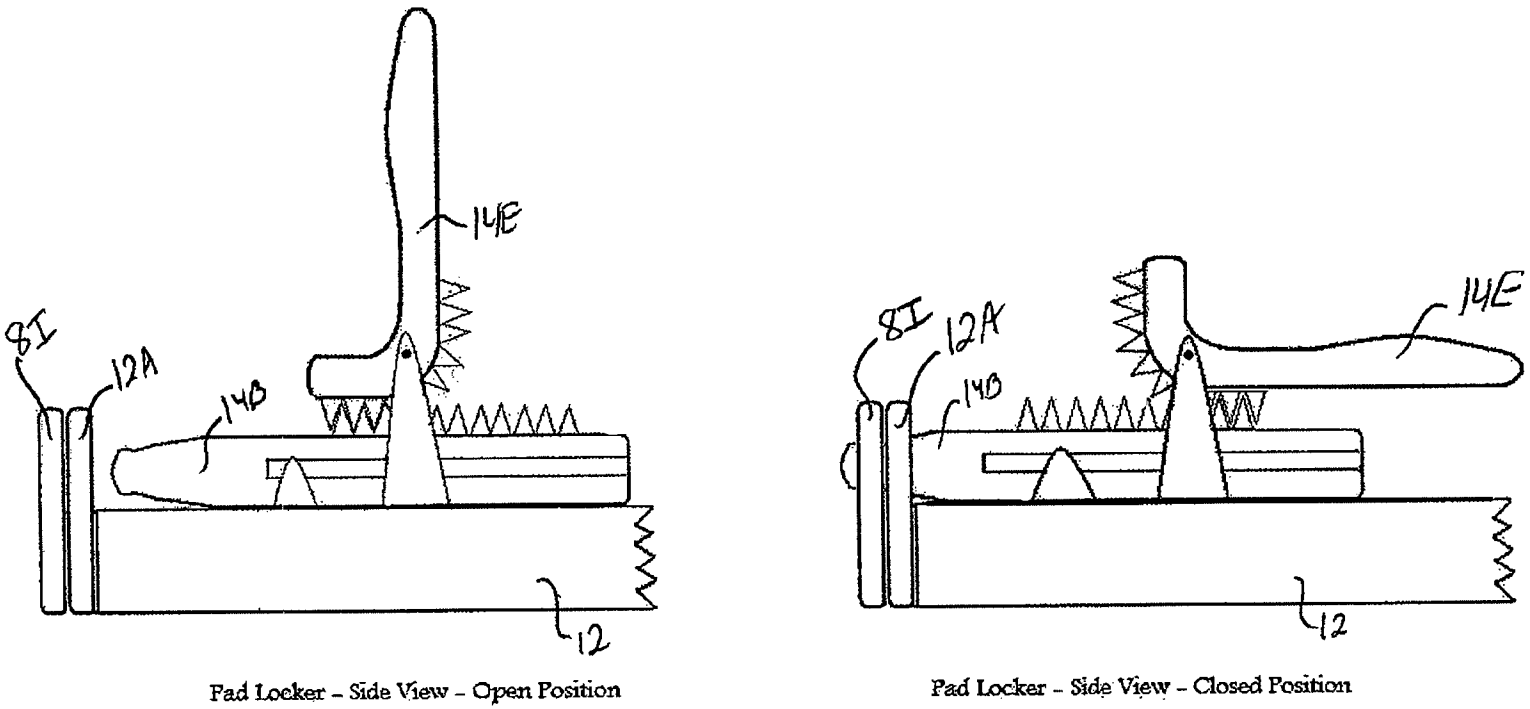
FIGURE 11 - PAD LOCKER

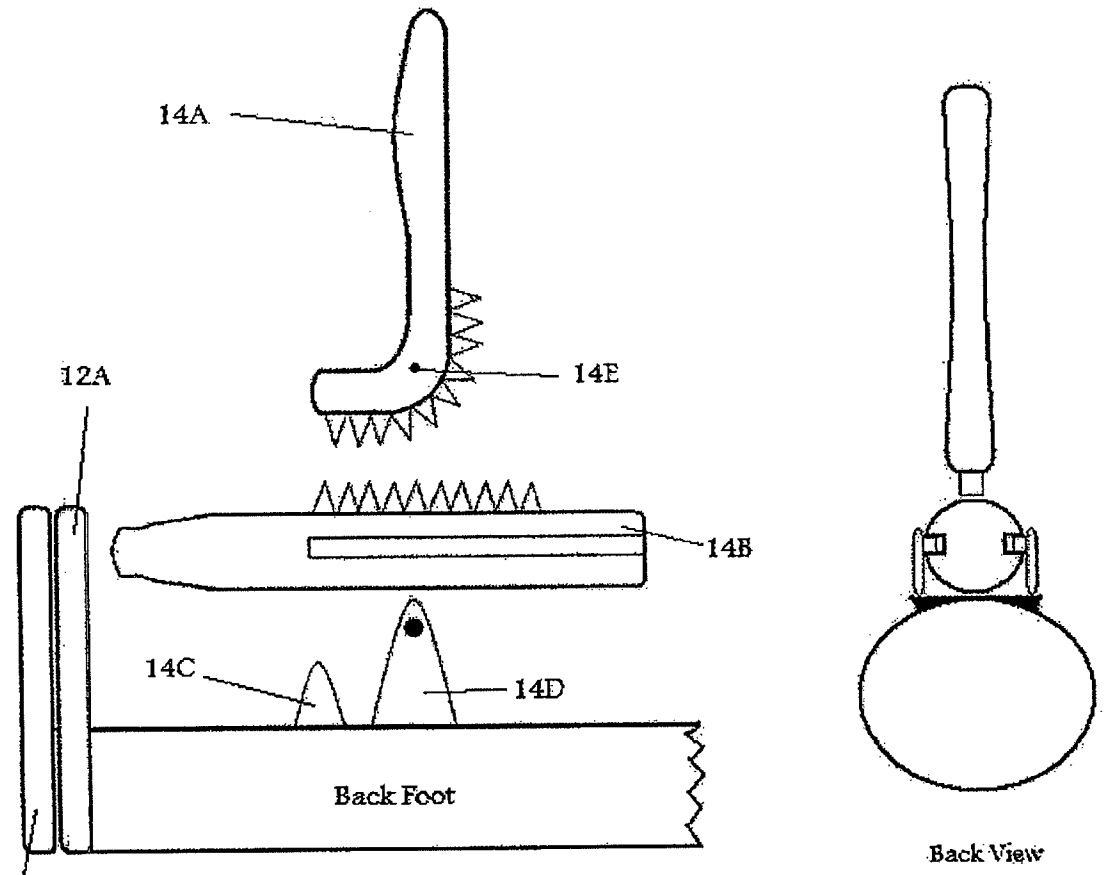
FIGURE 12 – PAD LOCKER BLOWN APART

FIGURE 17 – BARBELL AND RING

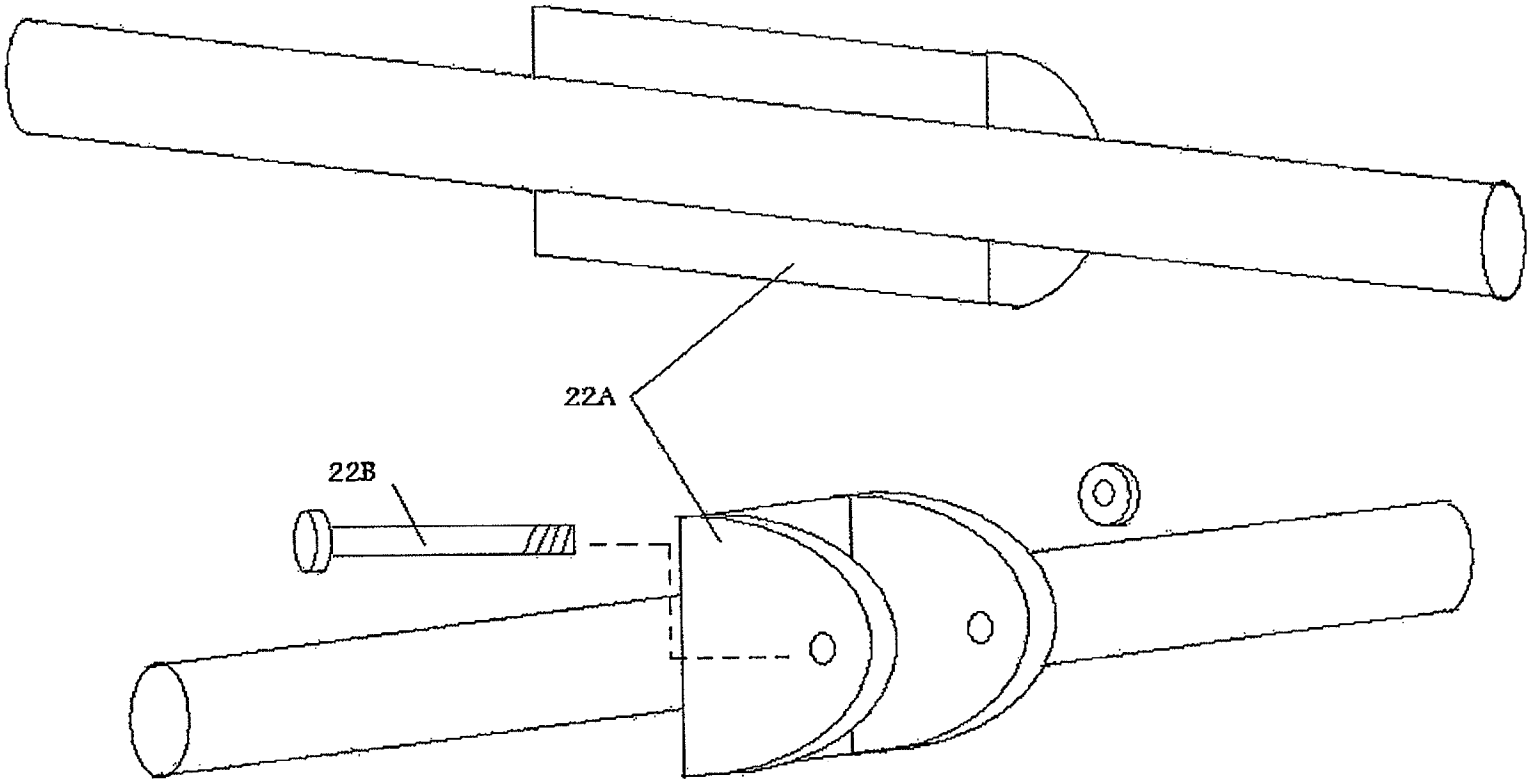
FIGURE 20 - SHIN CUSHION HOLDER

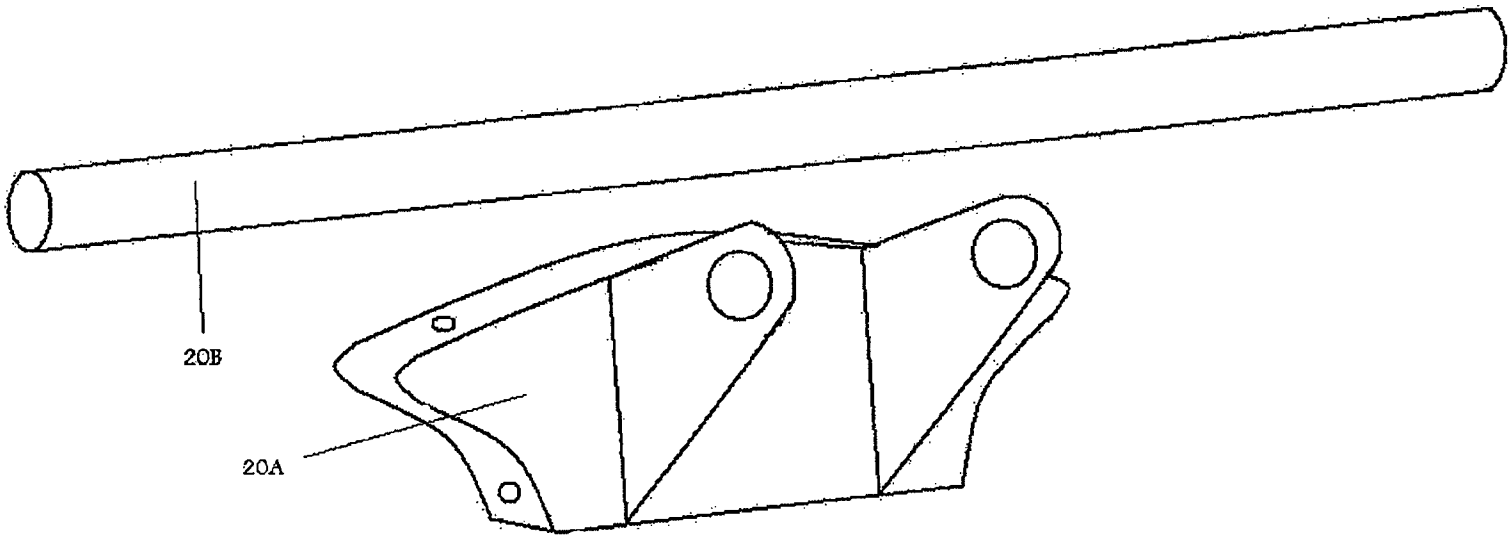
FIGURE 21- KNEE CUSHION RAIL CAP

MULTI-PURPOSE EXERCISE BENCH WITH VERSATILE RESISTANCE ACCESSORY

CROSS-REFERENCE FOR RELATED APPLICATION

This application claims the benefit of priority under 35 U.S.C. §119(e) to U.S. Provisional Patent Application No. 61/861,578, filed Aug. 2, 2013, the entire disclosure of which is hereby incorporated herein by reference.

FIELD OF THE INVENTION

The present invention relates generally to a multi-purpose exercise bench, and more particularly to a multi-purpose exercise bench having a versatile resistance accessory configurable for use to provide weight-training resistance in a variety of exercises.

BACKGROUND

Exercise benches of various sizes and configurations are well-known in the art. Such benches are used in weight training to assist in the performance of a variety of muscle-building exercises. Different bench configurations permit an exerciser to perform different exercises thereon to exercise and isolate different sets of muscles.

Some exercise benches are generally fixed, and facilitate performance of only one exercise or group of exercises. Some exercise benches are more versatile, and provide a range of adjustability to facilitate performance of a broader ranges of exercises for training different muscle groups.

One common type of bench includes a flat seat portion and an adjustable backrest that is adjustable between a flat position and an inclined position. In the flat position, both the seat and back portions are generally horizontal, and the user may lie in a supine position to perform chest presses and lateral butterflies, isolating a different set of upper body muscles then when the same exercises are performed on an incline bench. In addition, the exerciser can sit upright on the flat bench and perform a shoulder press exercise. In the inclined position, the seat remains generally horizontal and the backrest is inclined to permit a user to sit on the seat and recline in an at least partially upright position against the inclined backrest to perform a variety of upper body exercises on the bench, such as a chest press, lateral butterfly, and arm curl, each of which isolates and exercises a particular set of upper body muscles.

Such benches are commonly used in conjunction with free weights, such as a barbell born weight disks or "plates" and/or dumbbells. Some exercises may be performed with elastic resistance bands, often without the benefit of an exercise bench. Some exercises may have been performed using elastic resistance bands in conjunction with an exercise bench. Some exercise benches include integral resistance members, such as those manufactured and/or sold as BowFlex® brand home gyms by Nautilus, Inc. It has been observed that many of such exercise benches lack versatility to facilitate the broad range of exercises associated with a conventional multi-purpose exercise bench.

A simpler arrangement combining the conventional range of exercises associated with a multi-purpose exercise bench and the advantages of resistance band training is desired.

SUMMARY

The present invention pertains to a multi-purpose exercise bench having a versatile resistance accessory configurable for use to provide weight-training resistance in a variety of exercises. In one embodiment, a multi-purpose exercise bench comprises: an elongated frame configured to rest on a flat floor in a stable manner; a lower seat portion supported on the frame; a resistance accessory mounted to the frame, the resistance accessory comprising: a pad movably mounted to the frame to be movable between a first position and a second position; a locking mechanism operable to lock the pad in either of the first position and the second position; and a plurality of resistance bands attached to the pad.

BRIEF DESCRIPTION OF THE FIGURES

An understanding of the following description will be facilitated by reference to the attached drawings, in which:

FIG. 11 illustrates an exemplary locking mechanism for locking the pad in one or a plurality of predetermined positions;

FIG. 12 is an exploded view of the locking mechanism of FIG. 11;

FIG. 20 is a drawing of an exemplary shin pad cushion;

FIG. 21 is a drawing of a knee cushion rail cap; and

DETAILED DESCRIPTION

The present invention provides a multi-purpose exercise bench having a versatile resistance accessory configurable for use to provide weight-training resistance in a variety of exercises.

Figure 1:
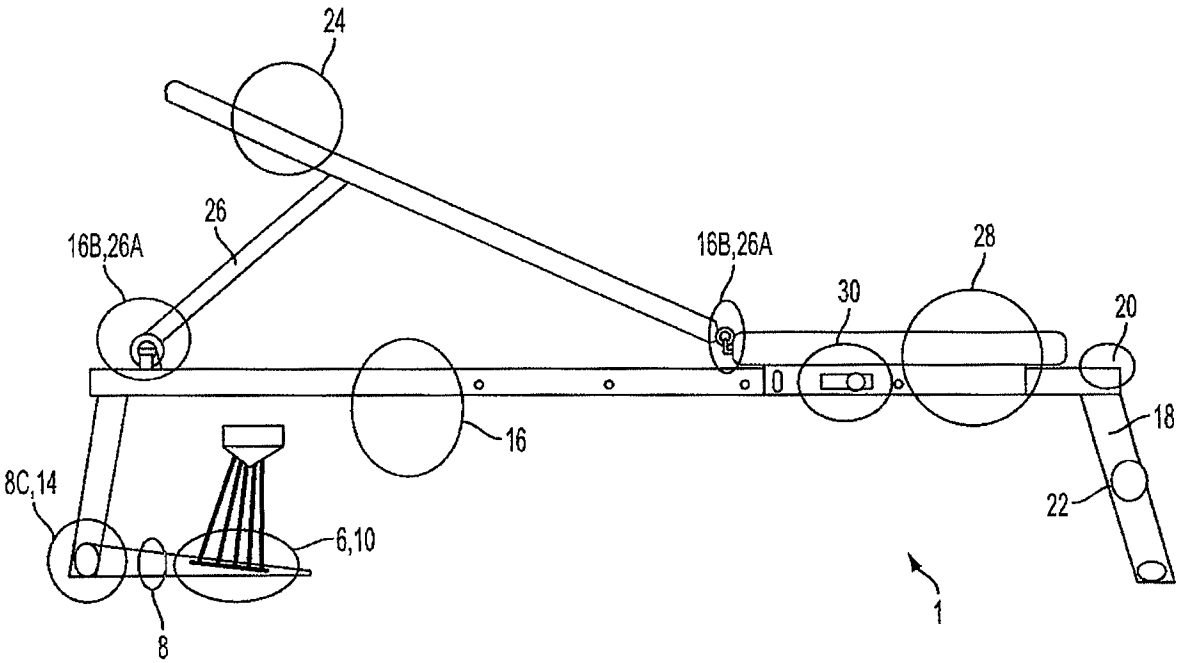
FIG. 1 is a side view of a multi-purpose exercise bench including a versatile resistance accessory in accordance with an exemplary embodiment of the present invention.

An exemplary bench is shown in FIGS. 1-21. Referring now to FIG. 1, an exemplary multi-purpose bench 1 is shown that has structure somewhat similar to a conventional multi-purpose bench, in that it includes a frame supporting a seat 28 and an adjustable back rest 24 that permit the bench to be used as either a flat bench or an incline bench in a variety of exercises. The frame includes a longitudinally extending frame rail 16 supported by legs, which optionally are configured to fold from an open position, in which they extended generally transversely to the frame rail, to a closed position, in which they are folded to form an acute angle with the frame rail. Additionally, the exemplary bench 1 includes a knee cushion 20 and shin cushion 22 providing a leg-station suitable for leg extensions and leg curls, as is generally known in the art.

In accordance with the present invention, the bench 1 further includes a versatile resistance accessory including a pad 8 mounted to the frame. In the exemplary embodiment shown, the pad 8 is mounted at the head end of the bench, adjacent the back leg 12. In accordance with the present invention, the pad 8 provides an attachment point for one or more resistance bands that may be used to provide resistance during strength training exercises.

Figure 3A:
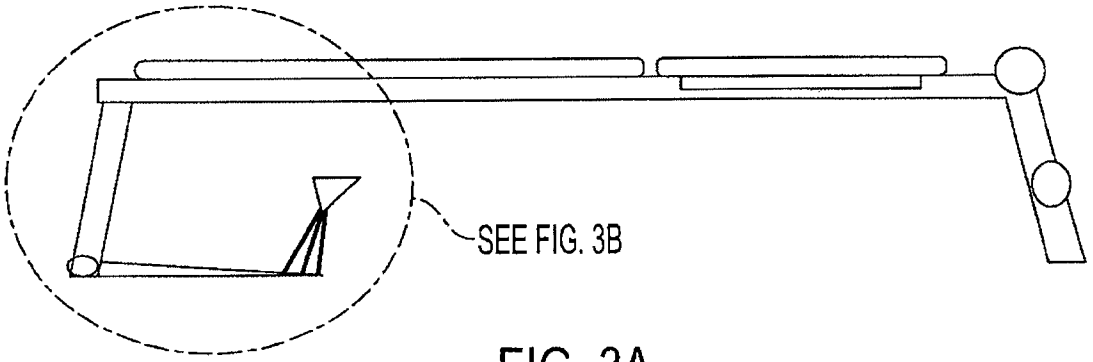
FIGS. 3A and 3B show side views of the accessory of FIG. 1.
Figure 3B:
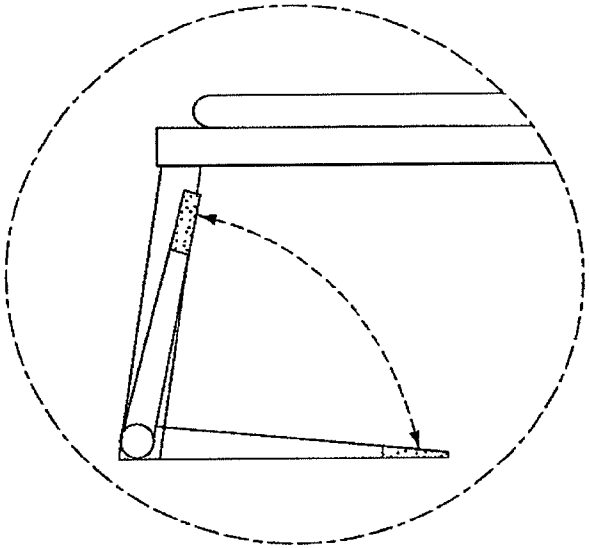

In a preferred embodiment, the pad 8 is mounted to the frame for movement between first and second positions. In the embodiment shown, the pad 8 is pivotably mounted to the back leg 12, and is pivotable between a first position in which the pad 8 is substantially vertical, and a second position in which the pad 8 is substantially horizontal, as shown in FIGS. 3A and 3B.

Figure 2:
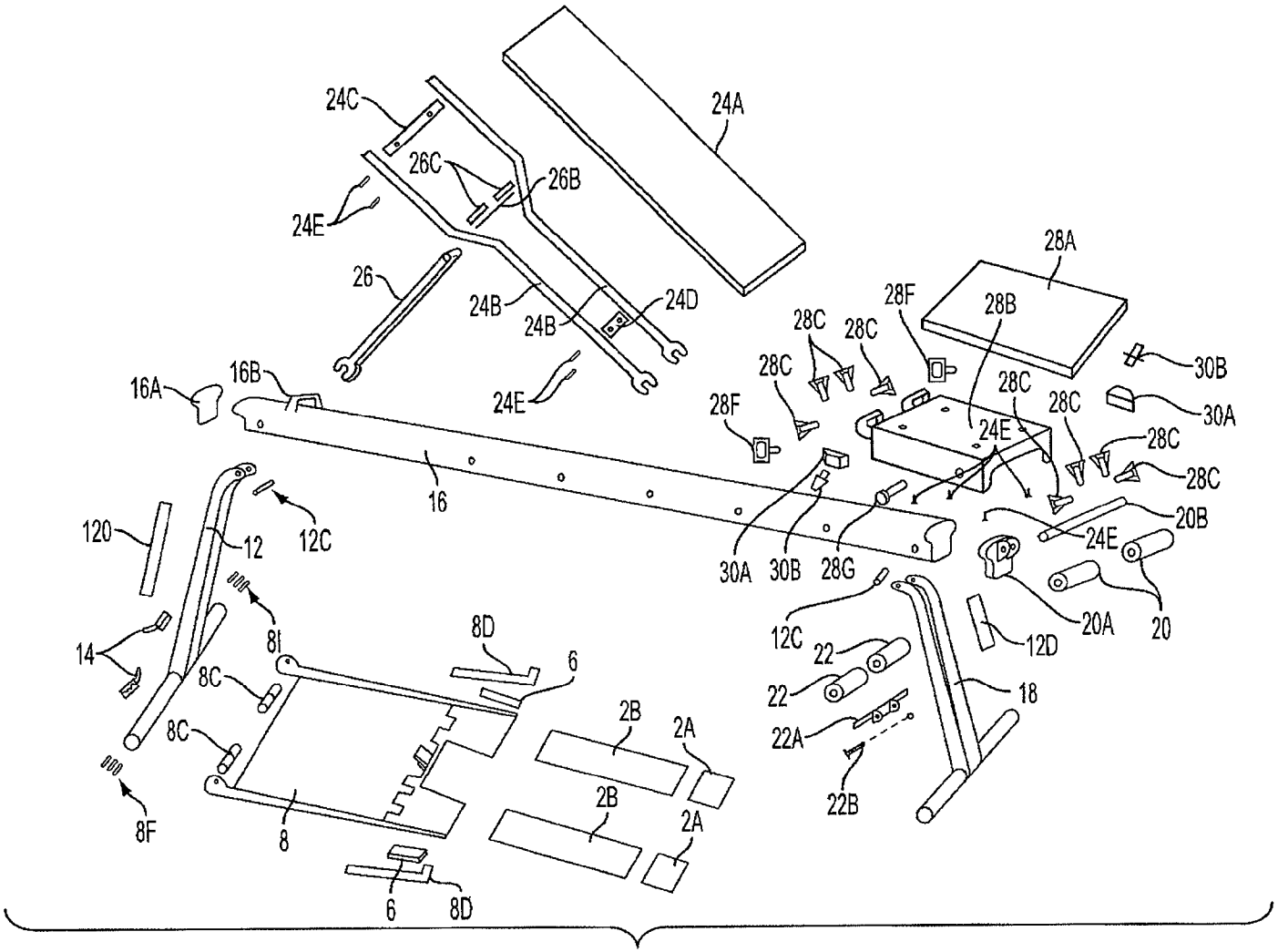
FIG. 2 is an exploded perspective view of the multi-purpose exercise bench of FIG. 1.
Figure 4:
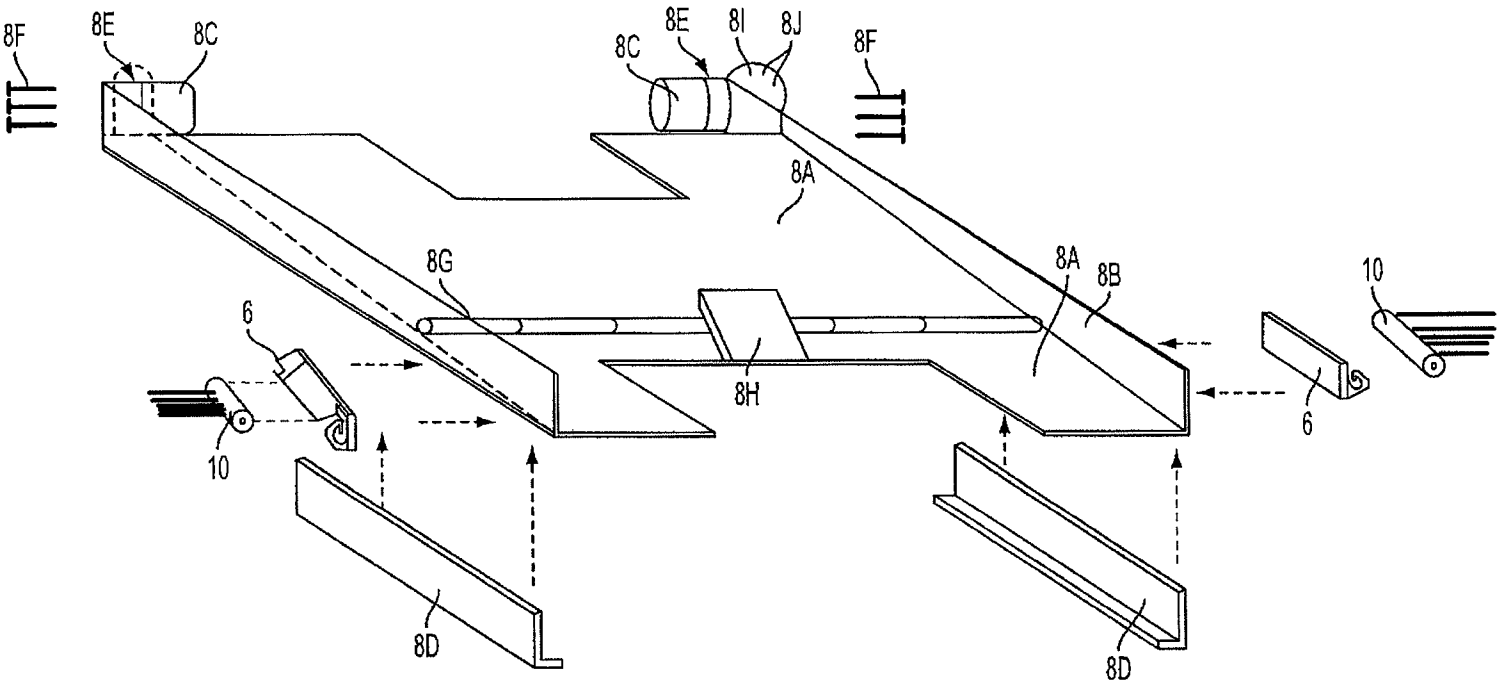
FIG. 4 is an enlarged view of an adjustable pad of the accessory of FIG. 1.
Figure 10B:
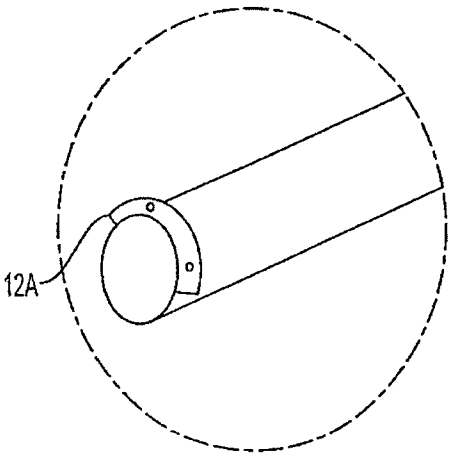
FIGS. 10A and 10B illustrate an exemplary pad, showing exemplary mating structures.
Figure 10A:
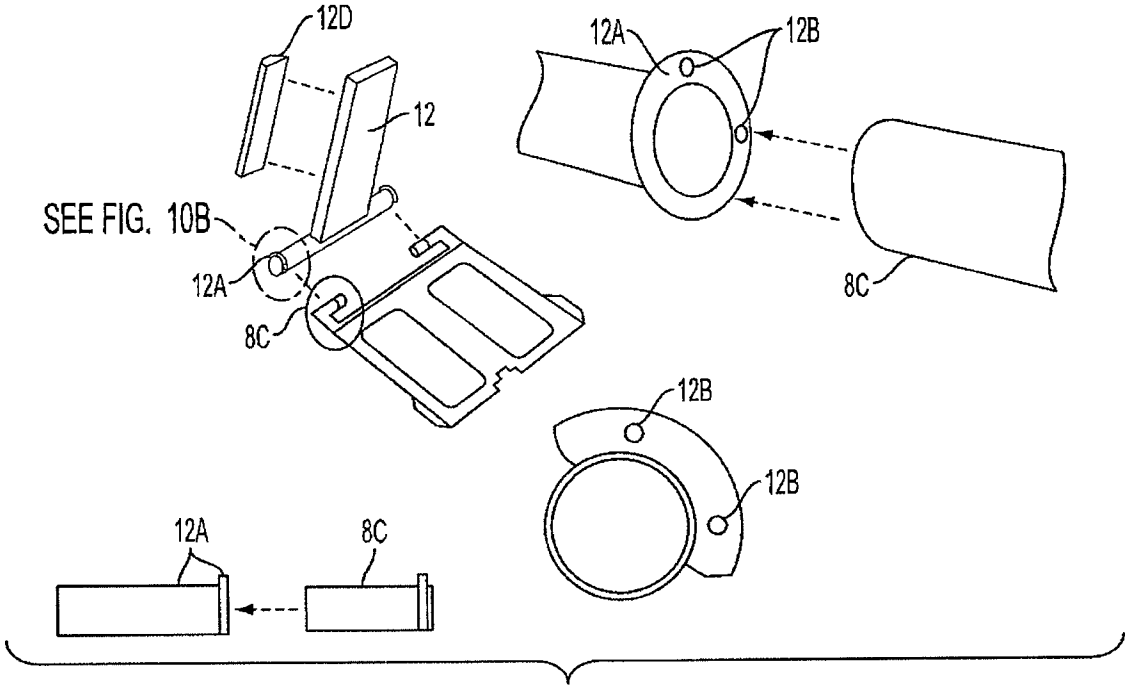
Figure 13A:
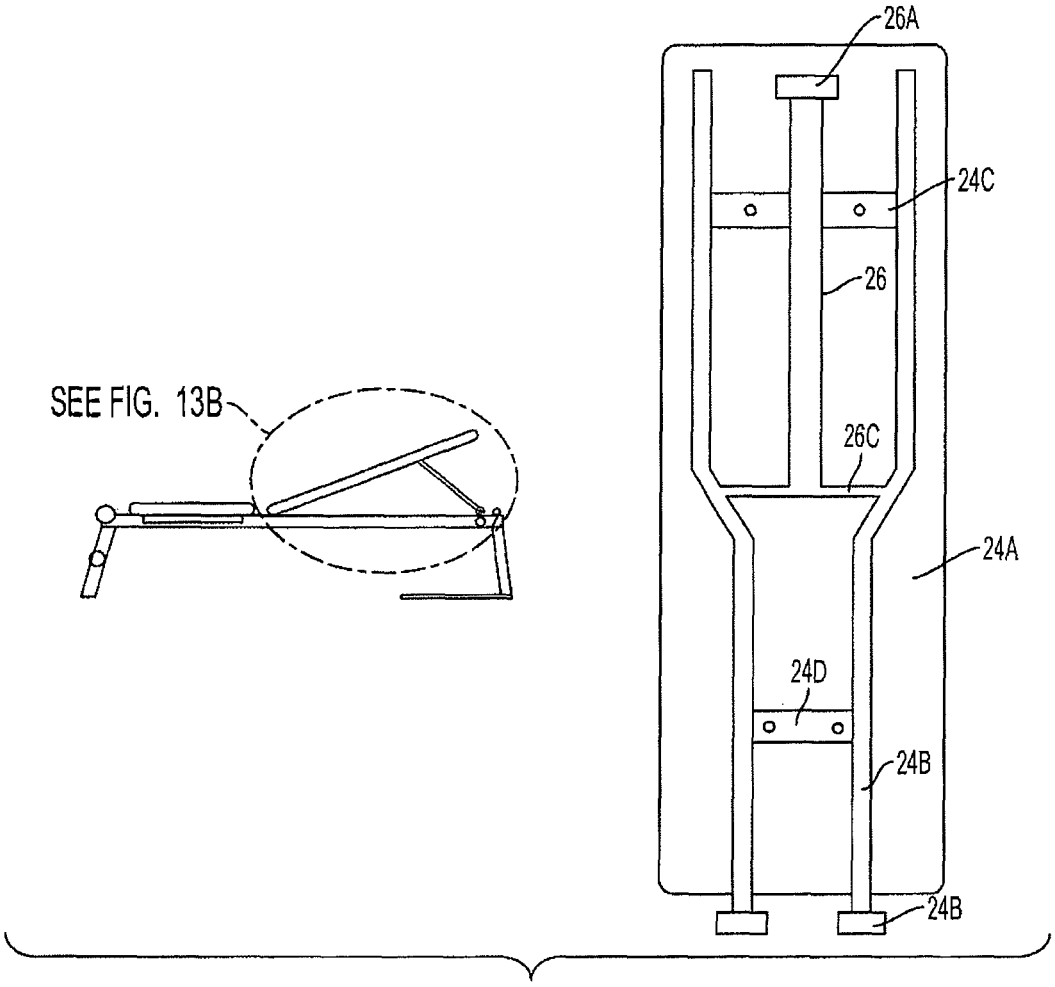
FIGS. 13A and 13B are drawings of an exemplary backrest/upper seat.
Figure 13B:
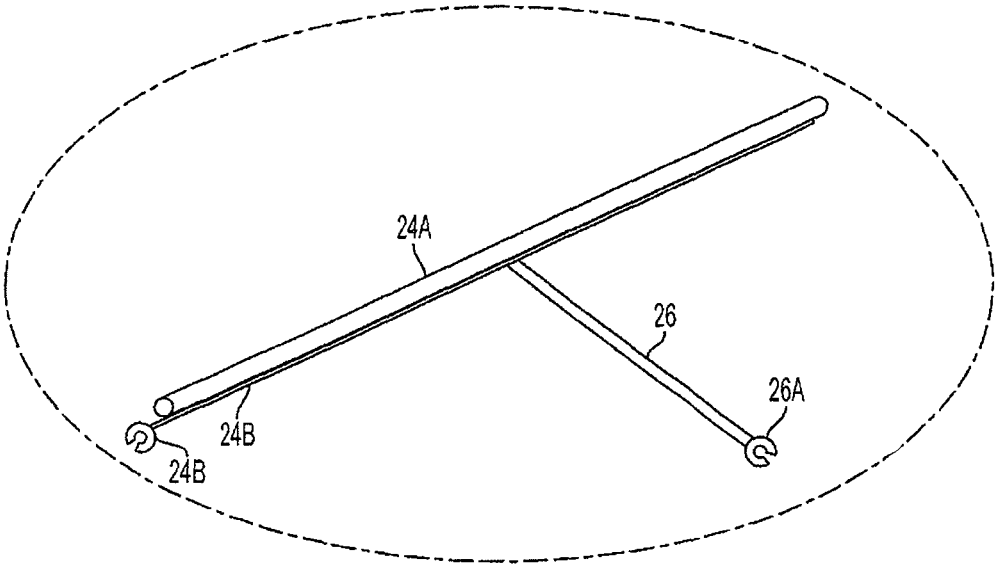

Further the pad is preferably lockable in one or more positions, so that the pad 8 and resistance bands tend to provide resistance during strength training. In the illustrated embodiment, the pad is provided with pins that nest within a horizontal portion of the back leg 12, so that the pad 8 may rotate relative to the rear leg, as best shown in FIG. 2. More specifically, the exemplary pad 8 includes pad inserts 8C that fit into the foot of the back leg 12. A ball bearing ring 8E allows the pad to fold smoothly and without play. Further, the pad includes a flange 8I including a plurality of holes 8J, and the back leg 12 includes a flange 12 with a plurality of holes 12B, as shown in FIGS. 2, 4 and 10. The holes are arranged to align at predetermined angular positions of the pad 8, to permit a pin to be placed through the aligned holes to effectively prevent relative motion of the flanges and pad/leg to lock the pad in position for use. Any suitable arrangement may be used to provide the pin. FIG. 11 shows an exemplary arrangement in which a locking mechanism is mounted on the rear leg 12. The mechanism includes a slidably mounted locker bolt 14B (the pin) that is caused to be inserted through or withdrawn from the aligned holes of the flanges 8I, 12A by way of a pivotable actuator 14E in toothed engagement with the locker bolt 14B to cause translational motion thereof when the actuator is pivoted, as best shown in FIGS. 11 and 12. In this embodiment, the locker both 14B has a tapered end to provide a snug fit in the holes of the flanges and to facilitate alignment thereof during insertion.

Figure 5:
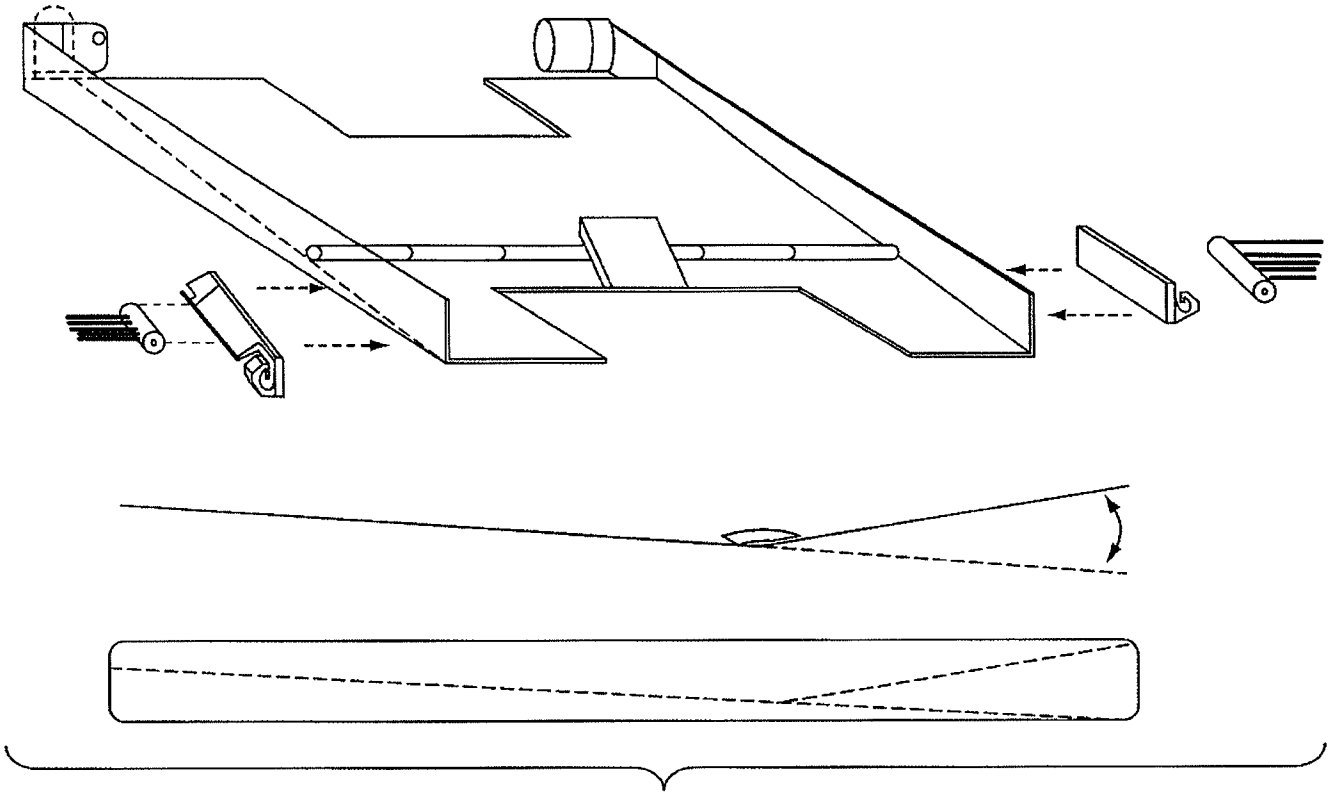
FIG. 5 is a side view of the pad illustrating the limited folding action of an exemplary pad.
Figure 6:
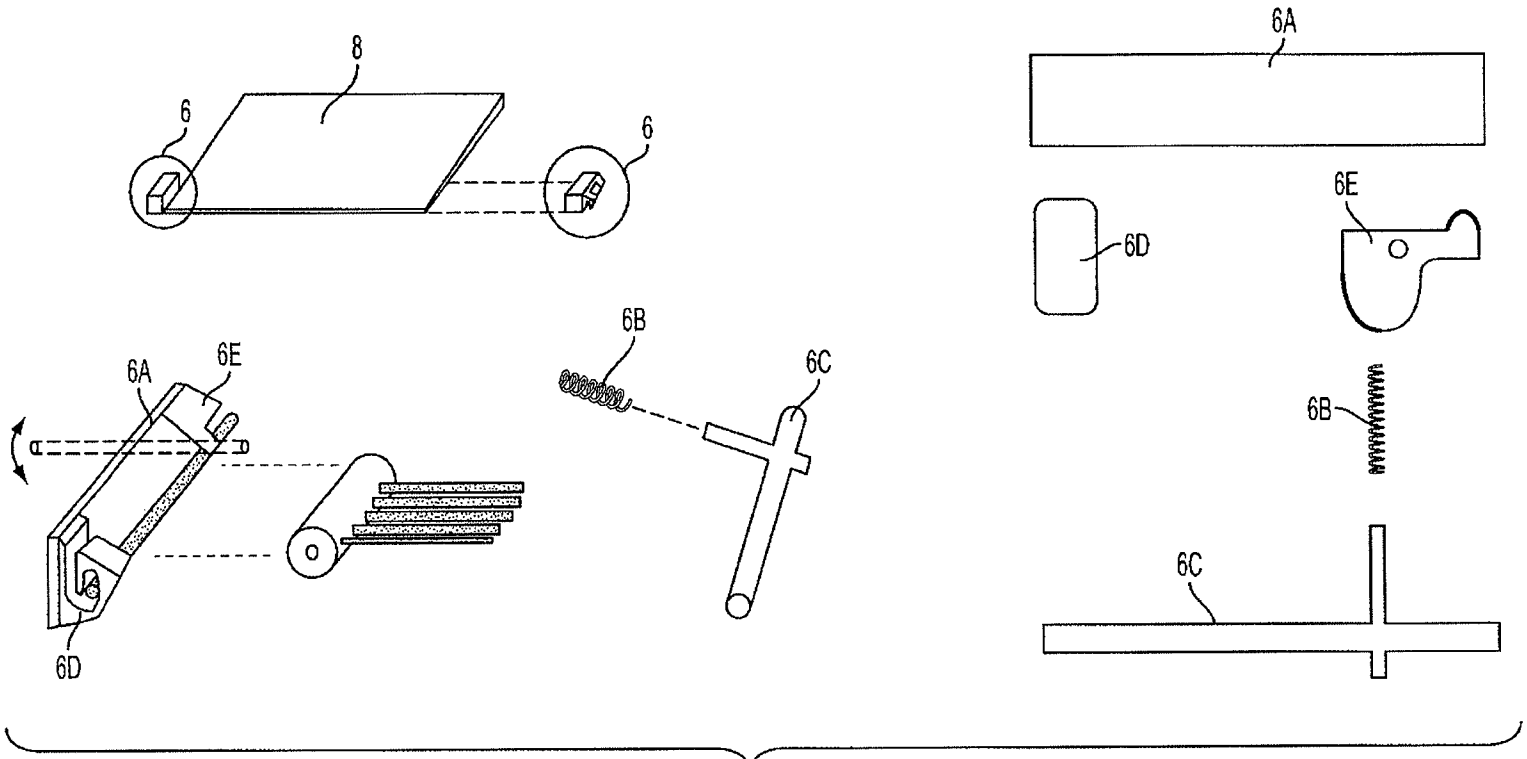
FIG. 6 is an exploded view of exemplary swing arms of the accessory.

In some embodiments, the pad 8 is not merely a unitary rigid plate-like body, but instead includes first and second portions movable relative to one another, as shown in FIGS. 2, 4 and 5. In this embodiment, the pad includes a hinged portion hingedly connected to a main portion of the pad's platform 8A. Accordingly, the hinged portion is pivotable between a first position and a second position, as shown in FIG. 6. In this embodiment, the pad 8 includes a stop 8H to limit the range of motion of the hinged portion relative to the remainder of the platform 8A. The hinge 8G permits the hinged portion to be pivoted into a position better suited for performance of an exercise. Accordingly, the hinged portion provides an extra measure of adjustability to the pad. For example, the pad may be locked in a substantially upright position, and the hinged portion may then be further pivoted toward an upright position for use in a leg press exercise.

Figure 7:
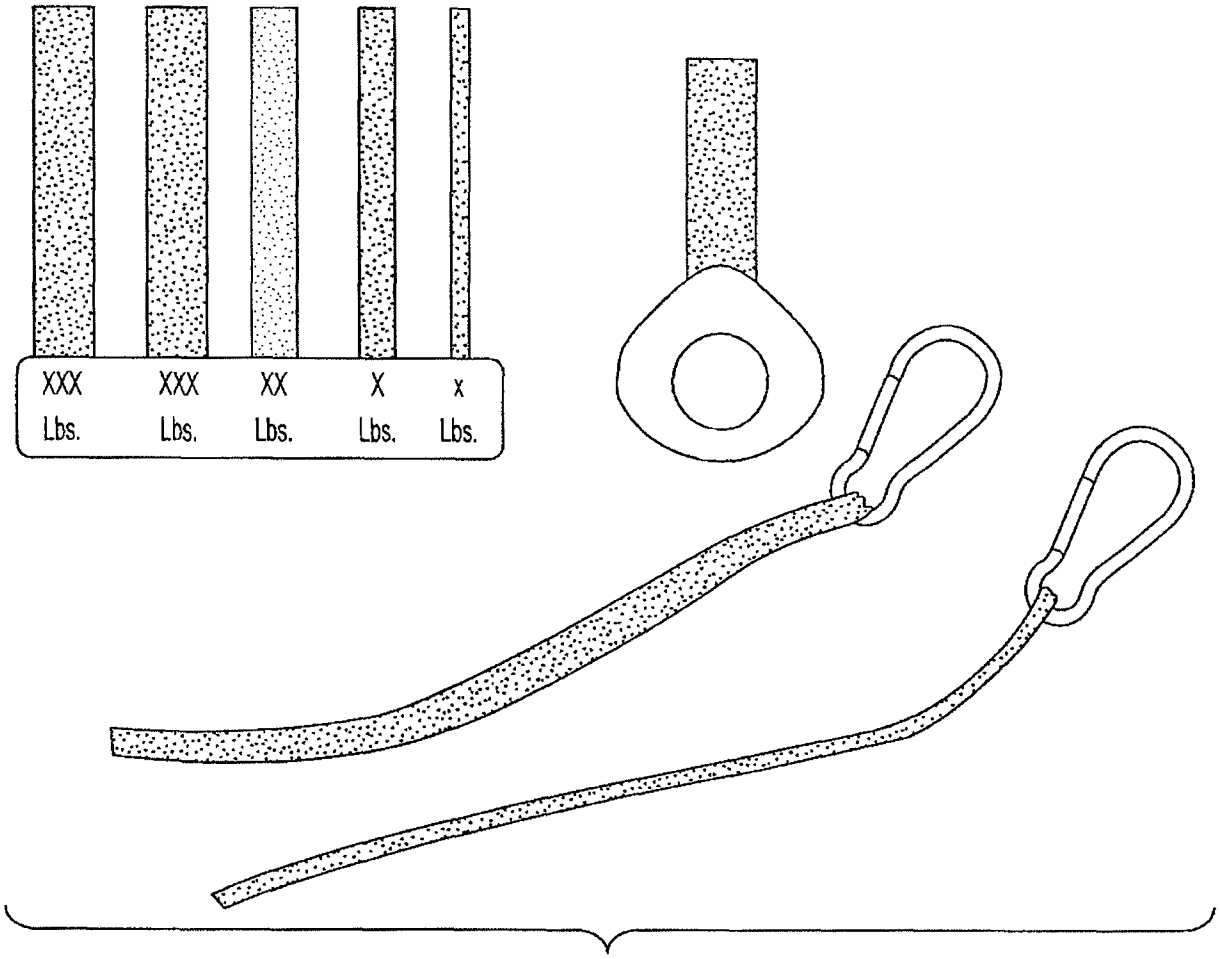
FIG. 7 is a drawing of an exemplary resistance band housing unit for mating with a swing arm.
Figure 8:
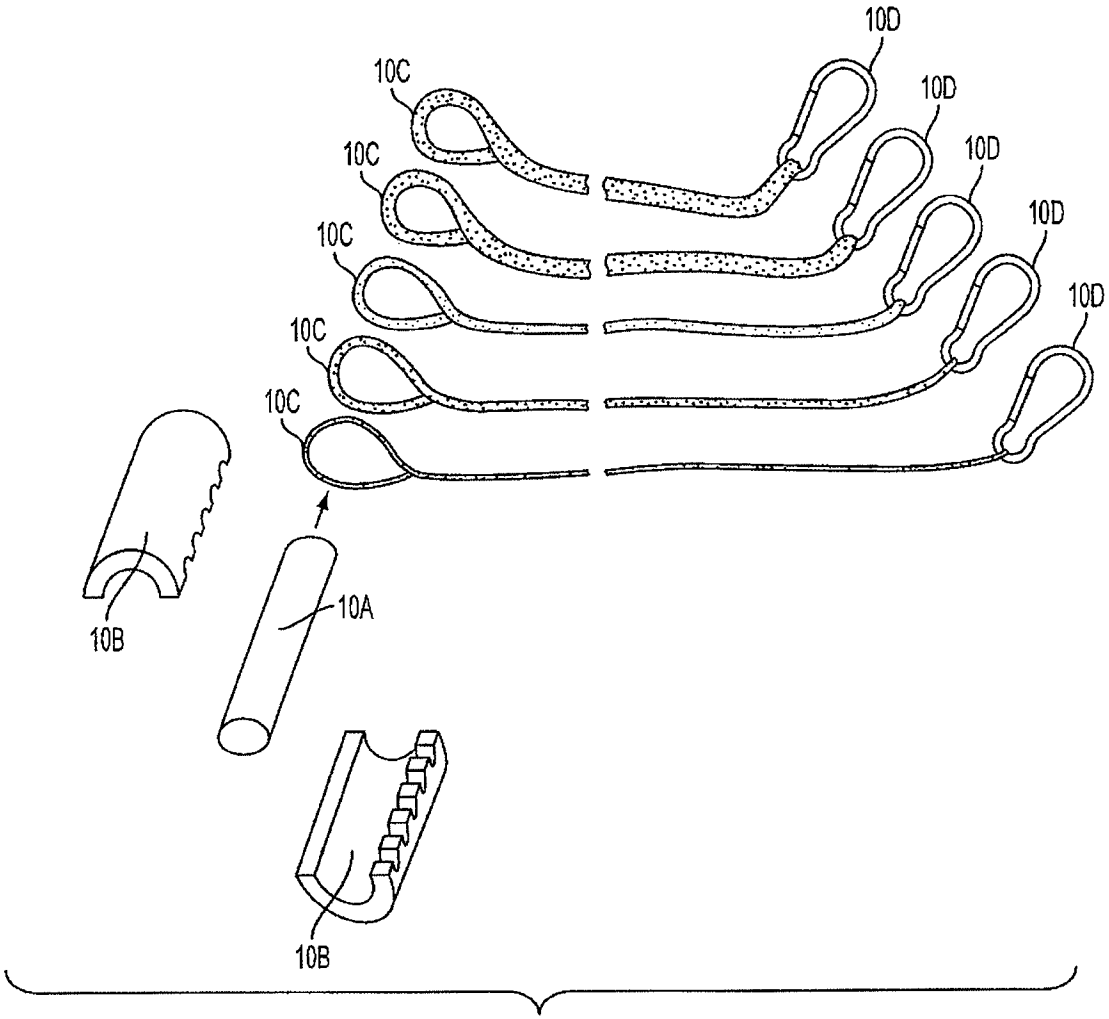
FIG. 8 is an exploded view of a resistance band housing unit of FIG. 7.

The resistance bands are mounted to the pad 8. In this embodiment the resistance bands are joined in a resistance band housing unit 10, as shown in FIGS. 7 and 8. As shown in FIG. 8, the housing 10 includes a hollow outer tube 10B and a hollow inner center tube 10A. The outer tube 10B has a plurality of openings, and the resistance bands 10C are looped around the inner tube 10A, which is positioned within the outer tube 10B, and the resistance bands 10C exit through the holes in the outer tube 10B. This serves to anchor multiple resistance bands to a single housing unit 10. An opposite end of the resistance band may be joined to an attachment clip 10D, such as a carabiner, as shown in FIGS. 7 and 8. The clip 10D facilitates attachment of selected resistance bands to a bar or other member for exercise purposes.

Figure 9A:
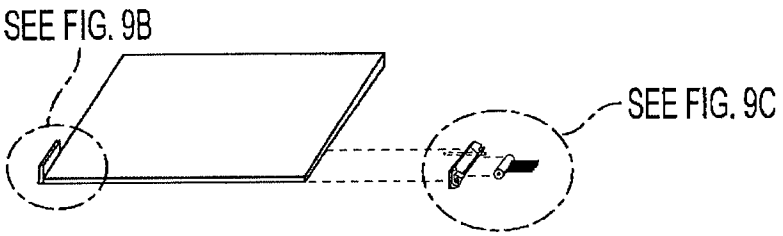
FIGS. 9A-9C show the placement of the swing arms on the pad and the mating of the resistance band housing units on the swing arms.
Figure 9C:
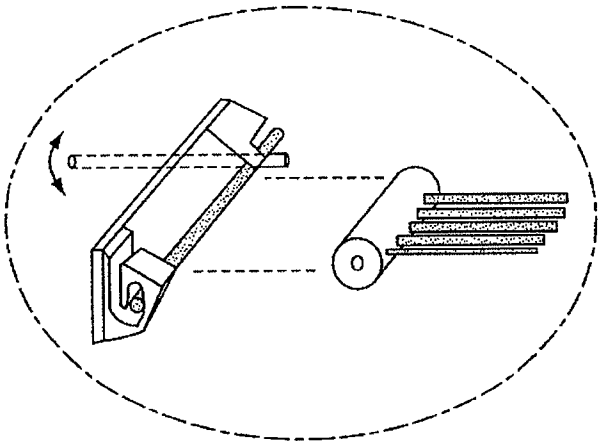
Figure 9B:
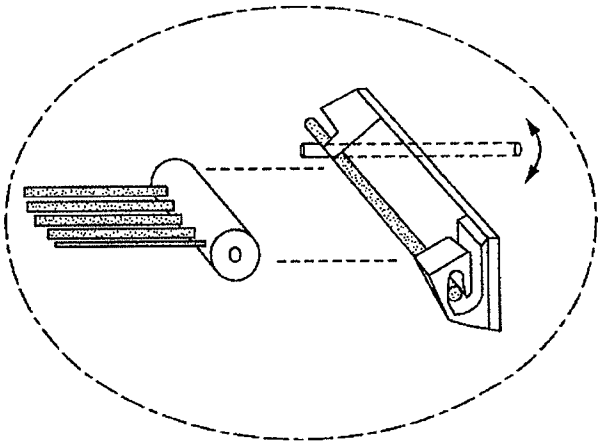

The pad 8 includes swing arms 6, which serve as attachments points for attaching the resistance band units 10 to the pad 8. Preferably, the swing arms 6 are attached toward the distal end of the pad on both lateral sides, as shown in FIGS. 2 and 6. Each swing arm 6 defines a path allowing a swing arm pin 6C to be received and retained by the swing arm, as shown in FIGS. 6, 9A and 9B. The pin 6C is placed through the inner tube 10A of the housing unit, then is placed in the path of the swing arm unit 6 to fix the resistance band unit 10 to the swing arm 6 and pad 8, as shown in FIGS. 6, 9A and 9B. After mounting, the resistance band housing unit is permitted to rotate about the pin 6C while still being retained by the swing arm unit 6, to permit the resistance bands to rotate into an operative position for a variety of exercises, e.g., due to a change in position of the pad 8.

Figure 14A:
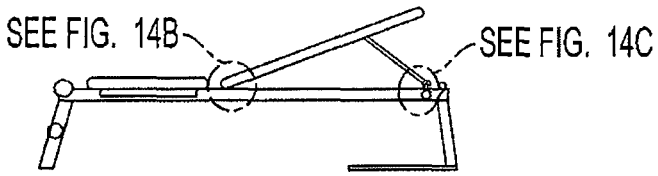
FIGS. 14A-14E show exemplary flat pin receivers working along with the flat pins to provide a quick-release mechanism for coupling and decoupling the backrest to the bench.
Figure 14B:
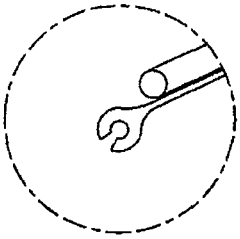
Figure 14C:
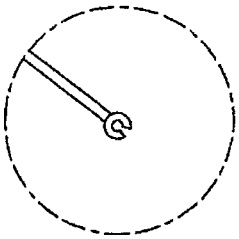
Figure 14D:
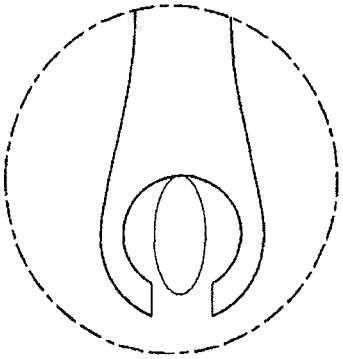
Figure 14E:
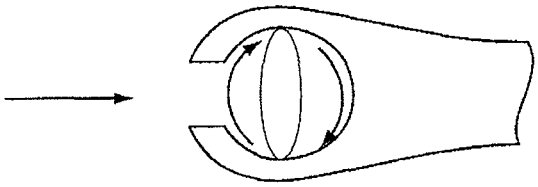
Figures 22A, 22B, 22C, 22D, 22E, 22F, 22G:
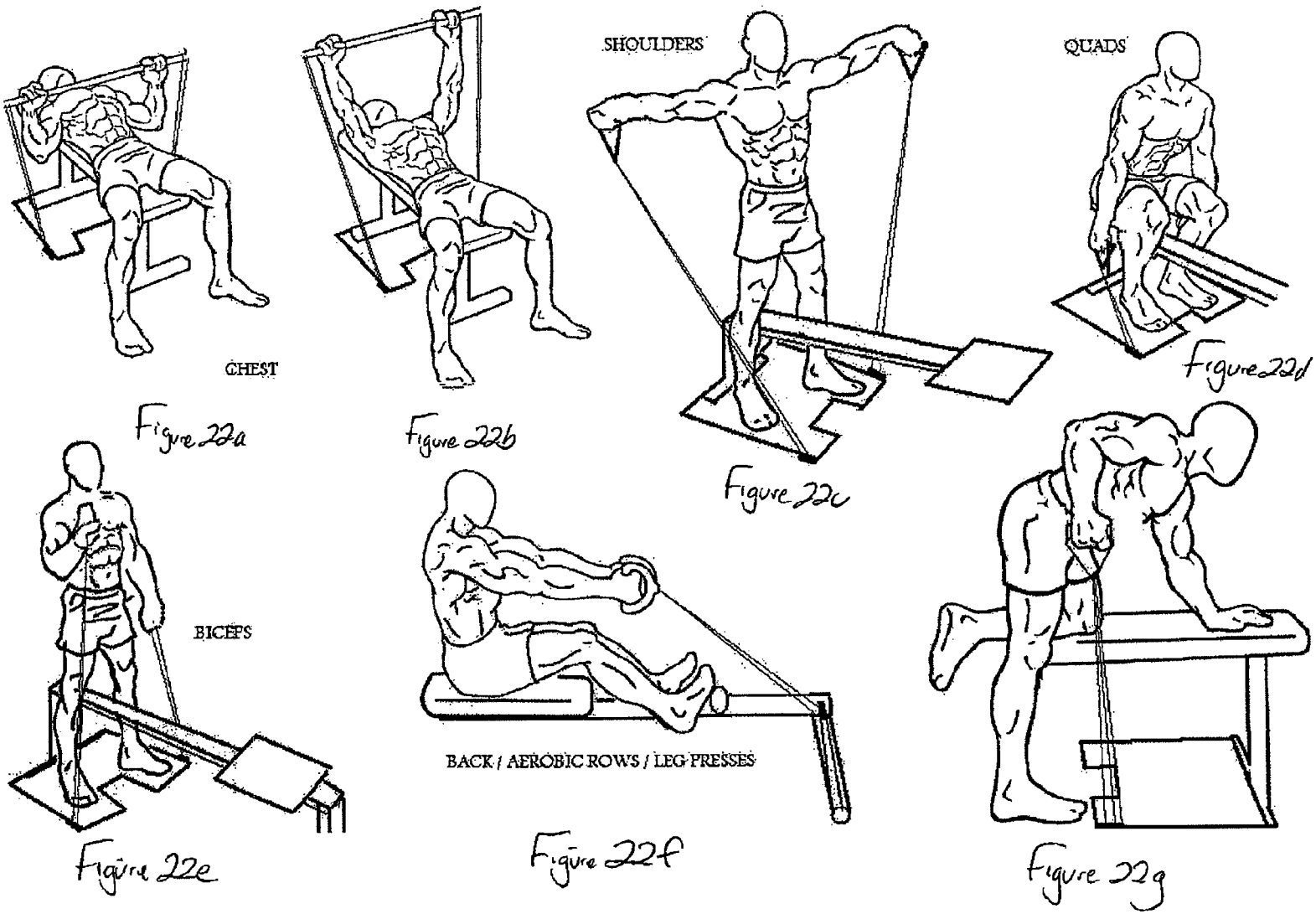
FIGS. 22*a*-22*o* illustrate various exercises that may be accomplished with the multi-purpose bench of FIG. 1.
Figure 22H:
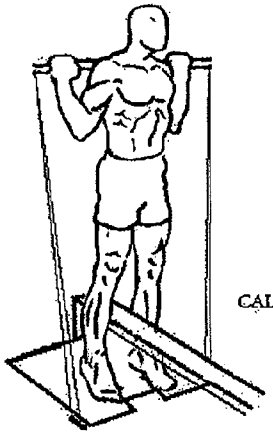
Figure 22I:
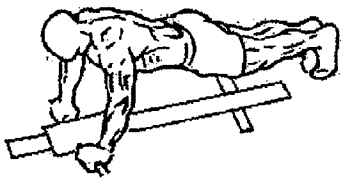
Figure 22J:
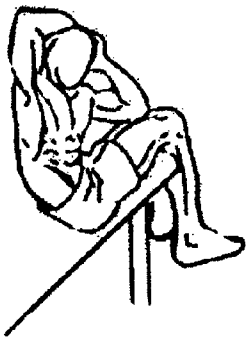
Figure 22K:
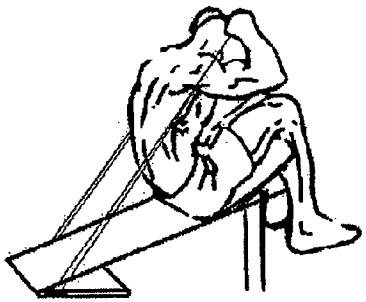
Figure 22L:
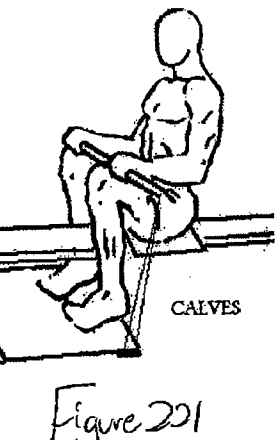
Figure 22M:
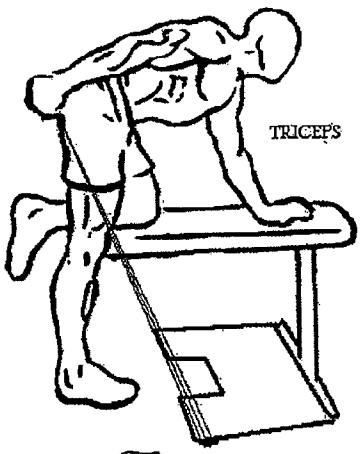
Figure 22N:
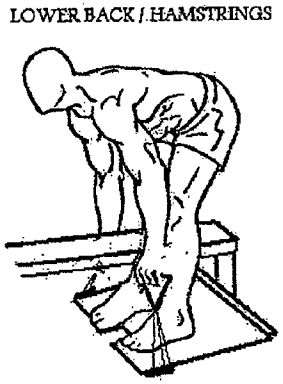
Figure 22O:
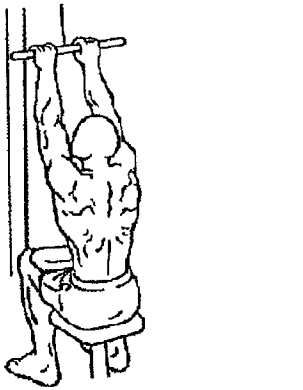

To facilitate use of the exercise bench in certain exercises, e.g., with the pad 8 positioned horizontally along the floor, it may be desirable to straddle the bench while standing on the pad 8, as shown in FIGS. 22*c*, 22*d* and 22*e*. Accordingly, the backrest 24 of the bench may be configured to operate substantially as in a conventional adjustable incline bench, and thus may include a backrest 24, cushion 24A. However, the bench may be modified in accordance with the present invention to include with a quick-release mechanism allow for easy, e.g., tool-free, decoupling of the backrest from the bench. In the exemplary embodiment show in FIGS. 13A and 13B, the bench is configured with a quick release mechanism that includes receivers 26 on the bench frame that include plate-like attachment pins for receipt in pin receivers. In the exemplary embodiment, the pins are plate-like and generally flat, and the pin receivers are generally of a split-ring design, as shown in FIGS. 13A-14B. Accordingly, pin receivers 24B, 26A tend to pivot about the pins, e.g. 16B, 26B, through a broad range of motion, but at a predetermined angular orientation, the pin aligns with the split in the ring-like receiver to permit the pin to exit the receiver, and thus the backrest and its supports to be decoupled from the frame, as best shown in FIGS. 14A and 14B.

Figure 15:
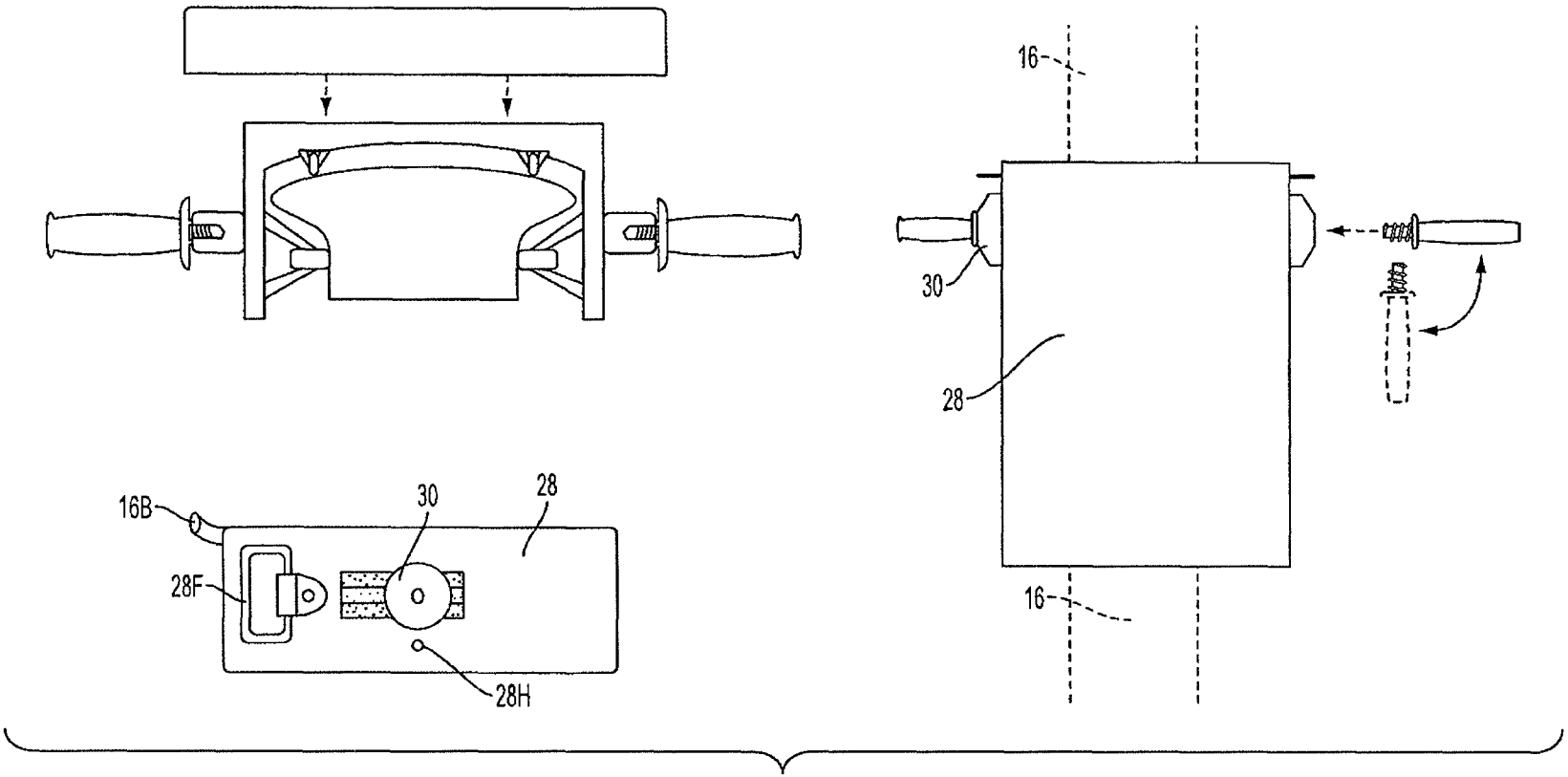
FIG. 15 includes front (upper left), side (lower left) and top (right) views of the lower seat of the bench of FIG. 1.

Any suitable seat may be used. In the exemplary embodiment shown, the bench includes a seat as provided in accordance with the present invention, as shown in FIG. 15. FIG. 15 is a drawing of the lower seat from the front (upper left), side (lower left) and top (right) view. The front view shows the lower seat 28 on wheels 28C on the frame rail 16.

Also shown are the handles 30 which are able to screw loose enough to be folded against the lower seat 28; the wheel housing unit 28B. Also seen in the front view is the cushion 28A to go on top of the wheel housing unit. The side view shows how the resistance bands can clip onto the lower seat via the clip holder 28F and that the flat pin 16B is a part of the wheel housing unit along with a stopper hole 28H that allows the lower seat to be locked into position. The top view shows the folding capability of the handles.

Figure 16:
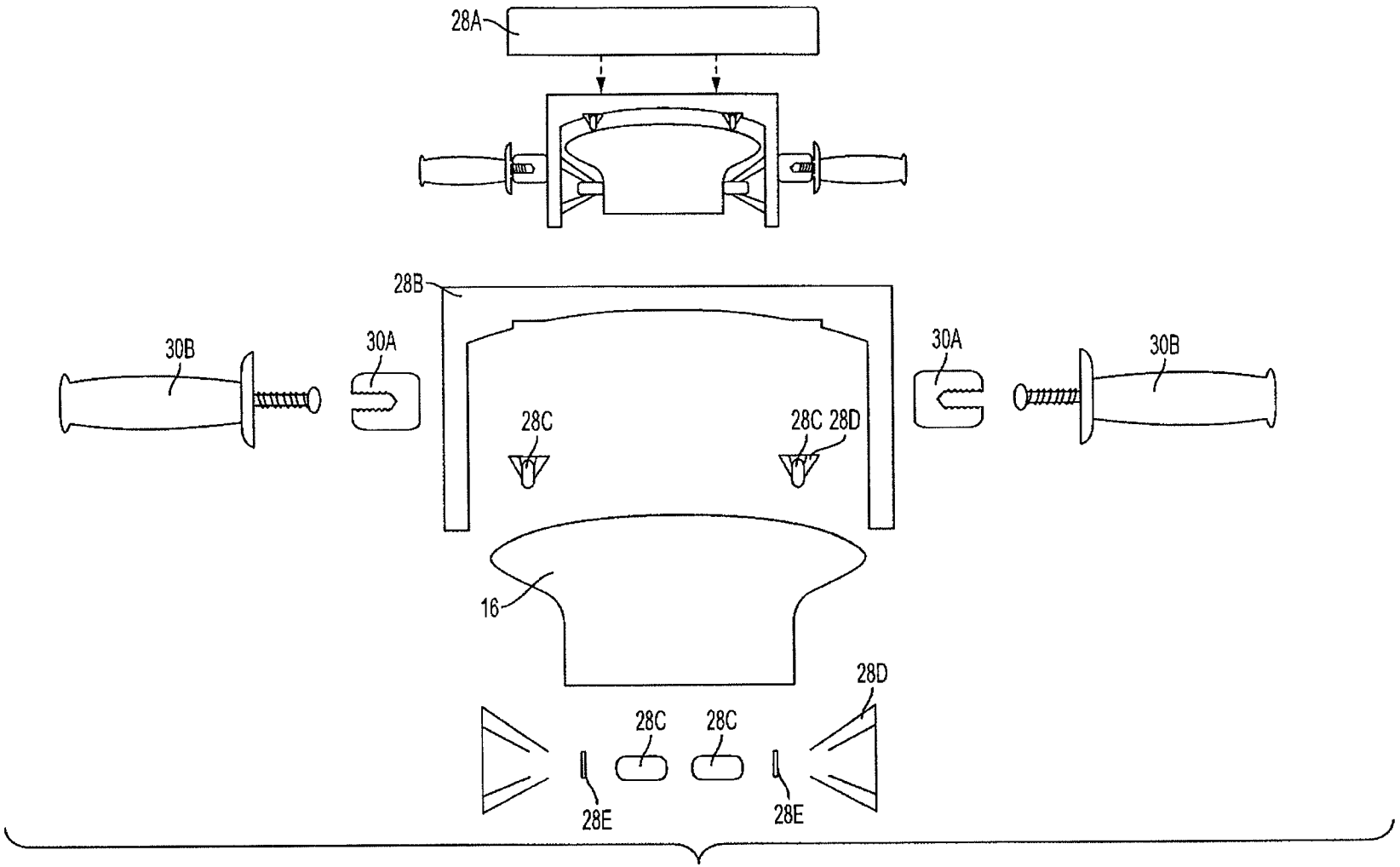
FIG. 16 is an exploded view of the set of FIG. 15.

FIG. 16 is an exploded drawing of the lower seat, including the wheel housing unit 28B; the wheel frame 28D; the wheels 28C; the wheel pins 28E; the lower seat handle housing 30A; and the lower seat handles 30B. Together these sit on and ride along the frame rail 16.

Figure 17:
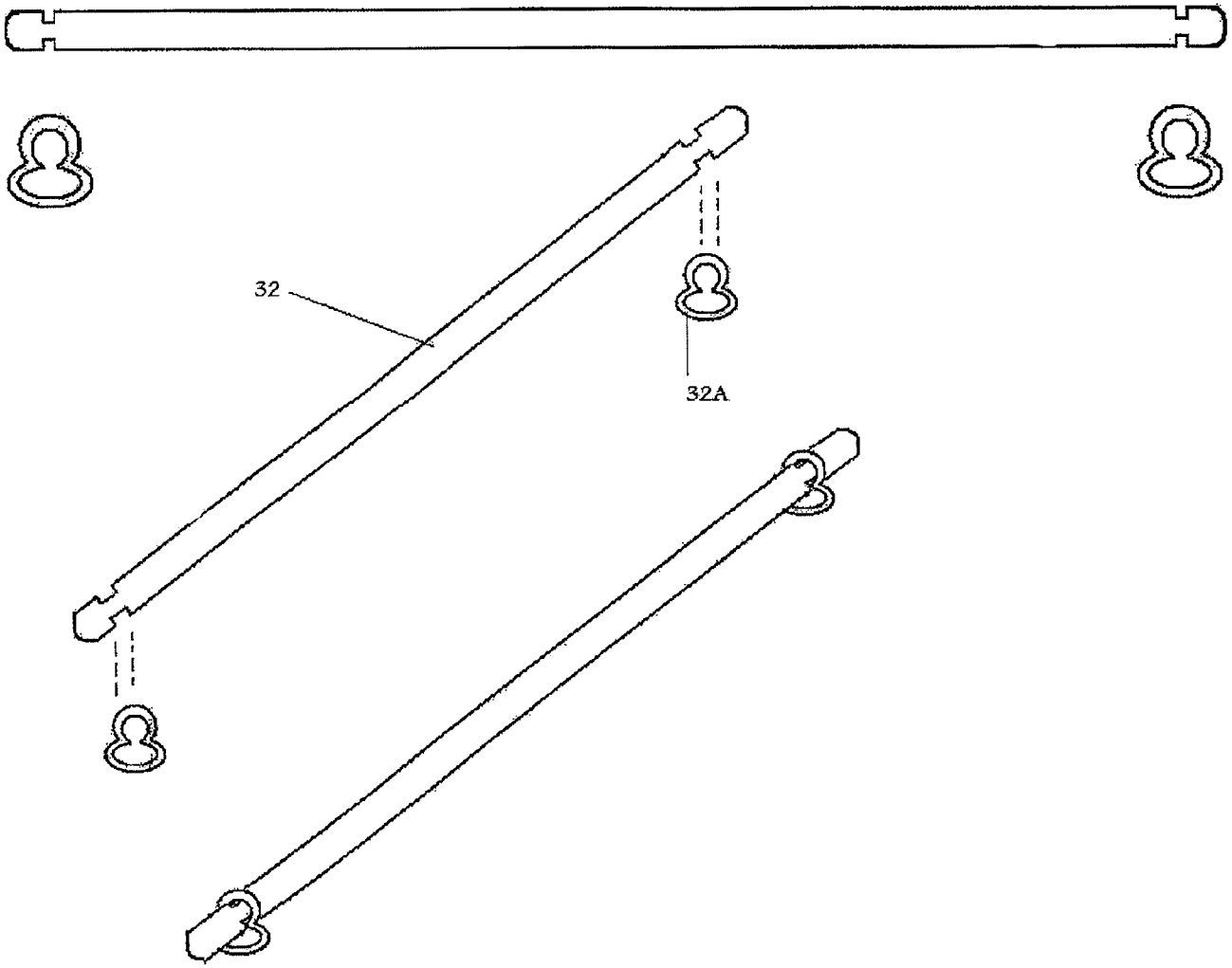
FIG. 17 illustrates an exemplary barbell configured to be used with the resistance bands by way of a receiver ring system in accordance with the present invention.

FIG. 17 is a drawing of an exemplary barbell to be used with the resistance bands. The exemplary barbell is typical of various other accessories in that it comprises a bar 32 configured to define grooves to receive a receiver ring 32A. This ring is shaped to fit into the grooves of the barbell to rotate freely yet not able to become disengaged from the bar. The larger part of the ring is to be used to allow the resistance band clips to fit onto.

Figure 18:
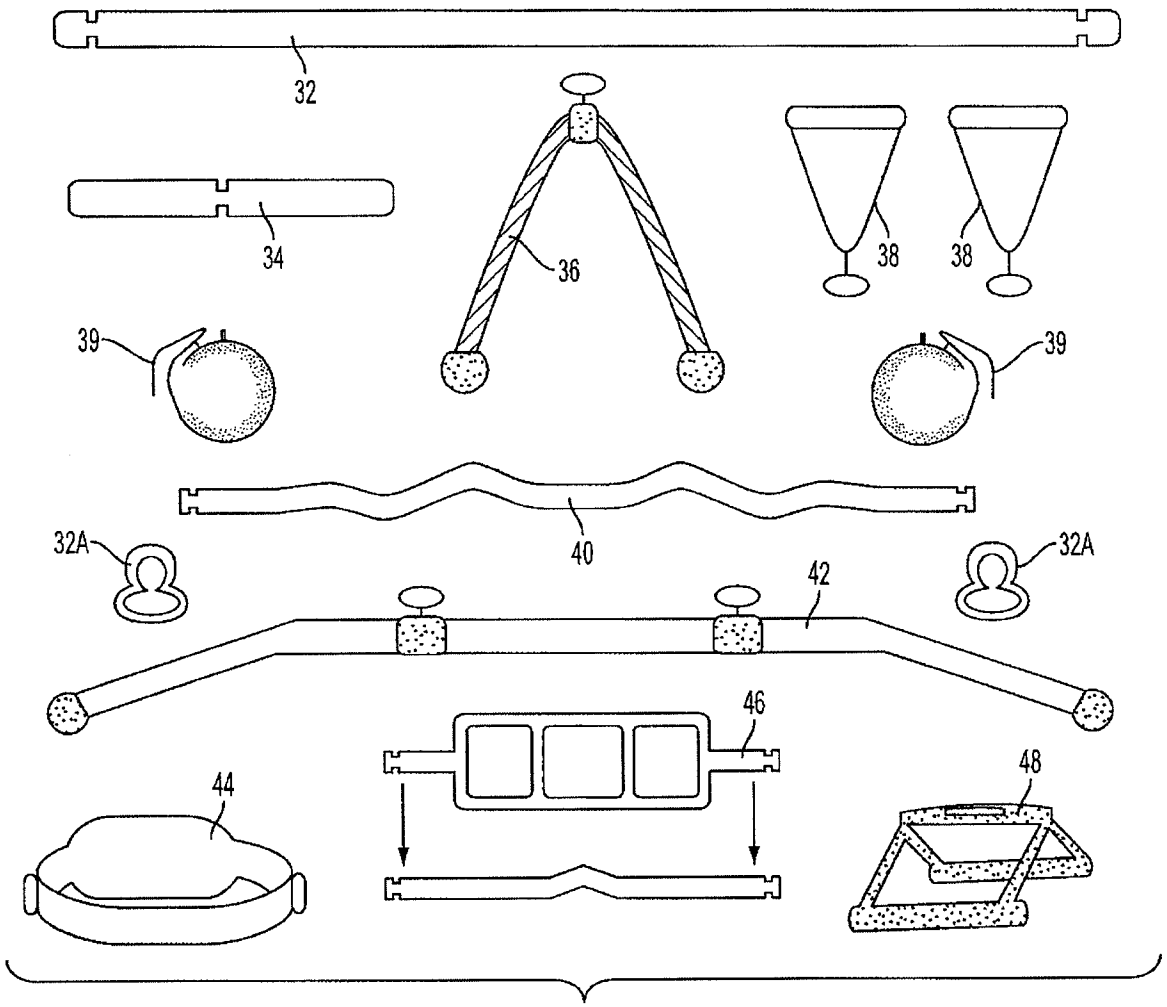
FIG. 18 illustrates various bars and handles to be used with barbell receiver ring system.

FIG. 18 is a drawing of various alternative bars and handles to be used with barbell receiver ring 32A system includes but is not limited to, a barbell 32; a short bar 34; triceps rope 36; single handles 38; ankle cuffs 39; an EZ curl bar 40; pull-down bar 42; belt 44; tricep bar 46; and a close grip handle 48.

Figure 19:
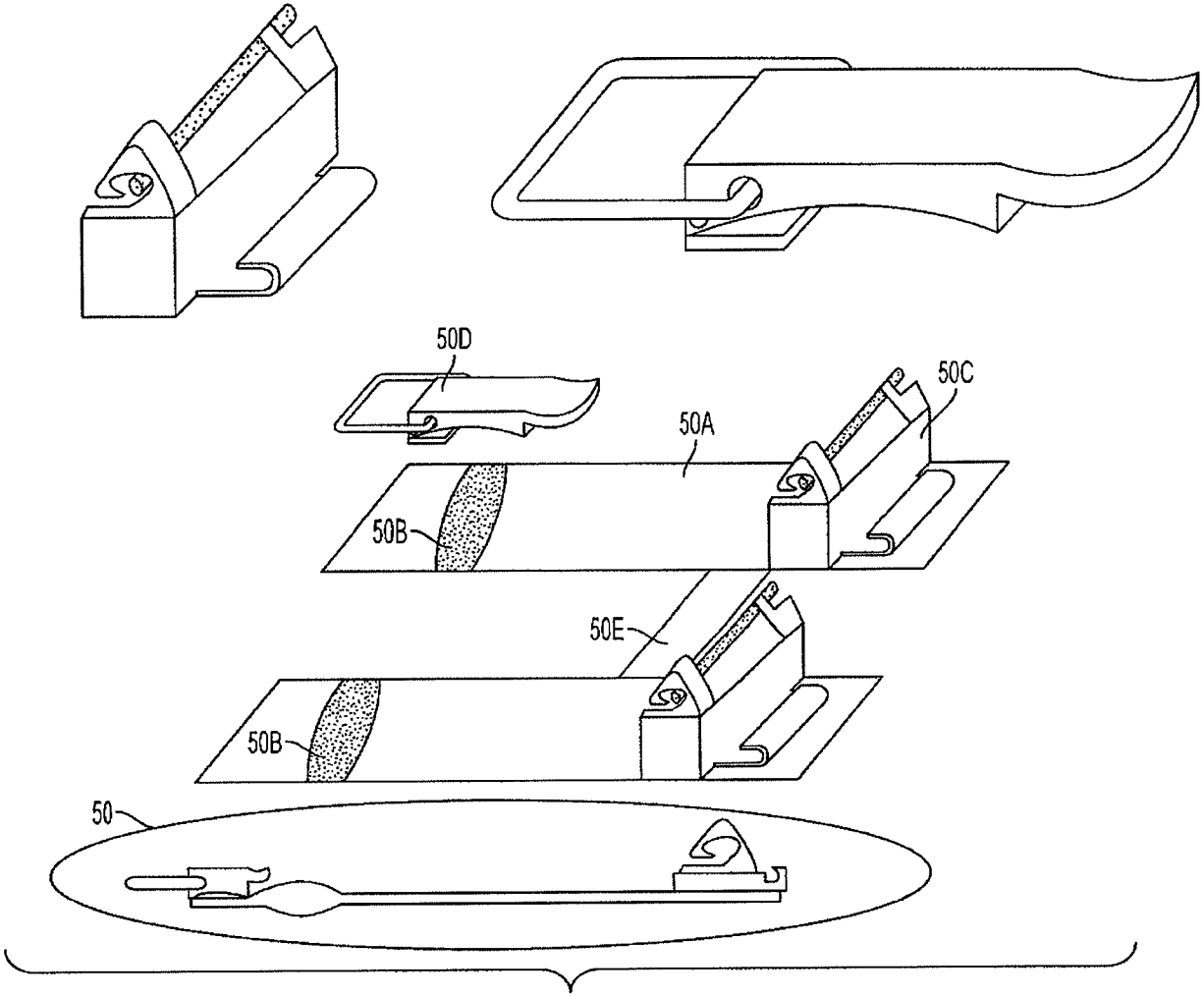
FIG. 19 illustrates a drawing leg and back accessory of the bench.

FIG. 19 is a drawing of an optional leg and back accessory 50. This accessory comprises swing arms with hooks 50C attached to heavy duty cloth straps 50A that can be wedged between a door and a door frame via a protrusion 50B. The swing arm has a hook to accept a latch 50D. The hook and latch allows the leg and back accessory to be wrapped around and secured to the front foot of the bench. Two of these straps may be connected via a stiff spacer 50E to complete one full leg and back accessory.

FIG. 20 is a drawing of an exemplary shin pad cushion 22A. The shin pad cushion holder is attached to the back part of the front leg approximately half way down and secured with the shin cushion bolt 22B.

FIG. 21 is a drawing of an exemplary knee cushion rail cap 20A. This is used to hold the knee cushions 20. The knee cushion pole 20B fits into the holes of the knee cushion rail cap. These are secured to the front end of the frame rail 16 via knee cushion bolts 20C.

In use, the assembled bench may be adjusted as desired before performing an exercise—e.g., to position the lower seat 28 in a suitable location along the frame rail, and to position the backrest 24 at a suitable position on the frame (flat or inclined), or removed from the frame, e.g., by manipulating the backrest 24 and its associated pin receivers relative to the pins on the frame rail 16 and/or lower seat 28 until the pins align with the splits in the pins receivers, and the moving the backrest to separate the pin receivers from the pins.

Next, the pad may be positioned as desired, e.g., in a upright or horizontal position, e.g., by unlocking the pad 8 by moving the appropriate actuator of the pad locking mechanism, pivoting the pad 8 until the holes in the flanges of the pad 8 and rear foot 12 align with the pad in the desired position, and then manipulating the actuator of the locking mechanism to lock the pad in the desired position.

Next the user may selected an appropriate bar/handle, attach the appropriate receiver rings 32A to the bar/handle, if necessary (in some embodiments the rings are permanently joined to the bar/handle), and then attach the clips of one or more resistance bands of the resistance band housing units 10 to the receiver rings 32A to provide the desired level of resistance.

Next, the user may manipulate the bar/handle in performance of the desired strength training exercise, against the resistance of the attached resistance bands.

A list of reference numerals is provided below for reference purposes:

| | |
|---|---|
| 2A | Small Rubber Pad |
| 2B | Large Rubber Pad |
| 6 | Swing Arm |
| 6A | Swing arm Plate |
| 6B | Swing arm Spring |
| 6C | Swing Arm Pin |
| 6D | Swing arm Pin Lock |
| 6E | Swing Arm Hinge |
| 8 | The Pad |
| 8A | Platform |
| 8B | Rail |
| 8C | Pad Inserts aka hinges |
| 8D | Pad protective strips for rail |
| 8E | Ball Bearings |
| 8F | Screws For Hinges |
| 8G | Hinge |
| 8H | Stopper For Hinge |
| 8I | Pad Flange |
| 8J | Pad Flange Hole |
| 10 | Resistance Band Housing Unit |
| 10A | Hollow Center Tube |
| 10B | Outer shell |
| 10C | Resistance bands |
| 10D | Clips |
| 12 | Back Leg |
| 12A | Back Foot With Flange |
| 12B | Flange Hole |
| 12C | Pin Or Bolt |
| 12D | Leg Protective Strip |
| 12E | protective strips for back foot |
| 14 | Pad Locker |
| 14A | Pad Locker Handle |
| 14B | Locker Bolt |
| 14C | Guide For The Bolt |
| 14D | Guide For The bolt and Pin insert |
| 14E | Pad locker Hinge Pin |
| 16 | Rail |
| 16A | End Cap |
| 16B | Flat Pin |
| 16C | Rail Holes |
| 18 | Front Leg |
| 18A | Bolt or pin |
| 18B | Front Foot |
| 18C | Front foot caps |
| 20 | Knee Cushion |
| 20A | Knee Cushion Rail Cap |
| 20B | Knee Cushion Pole |
| 20C | Knee cushion Bolt |
| 22 | Shin Cushion |
| 22A | Shin Cushion holder |
| 22B | Shin Cushion Bolt |
| 24 | Upper Seat |
| 24A | Cushion |
| 24B | Upper Seat Rails With Flat Pin Receivers |
| 24C | Cross Brace Big |
| 24D | Cross Brace Small |
| 24E | Screws For Cushion |
| 26 | Incline Adjuster |
| 26A | Flat Pin Receiver |
| 26B | Bolt |
| 26C | Stabilizers |
| 28 | Lower Seat |
| 28A | Cushion |
| 28B | Wheel Housing Unit |
| 28C | Wheels |
| 28D | Wheel Frames |
| 28E | Wheel Pins |
| 28F | Clip Holder |
| 28G | Stopper Bolt |
| 28H | Stopper Hole |

-continued

| | |
|---|---|
| 30 | Lower Seat Handles |
| 30A | Handle Housing That Holds Knobbed screw |
| 30B | Handle With Knobbed Screw |
| 31 | Front Leg |
| 32 | Barbell |
| 32A | Receiver Ring |
| 34 | Short Bar |
| 36 | Triceps Rope |
| 38 | Single Handles |
| 39 | Ankle Cuffs |
| 40 | EZ Curl Bar |
| 42 | Pull-Down Bar |
| 44 | Belt |

-continued

| | |
|---|---|
| 46 | Tricep Bar |
| 48 | Close Grip Handle |
| 50 | Accessory |
| 50A | Cloth Strip |
| 50B | Protrusion |
| 50C | Swing Arm With Hook |
| 50D | Latch |
| 50E | Spacer |

PARTS LIST

| | |
|---|---|
| 2A | Small Rubber Pad- Attached to the top front of the pad for comfort |
| 2B | Large Rubber Pad - Attached to the top back of the pad for comfort |
| 6 | Swing Arm - The swing arm allows the resistance bands to be secured in place quickly and easily |
| 6A | Swing Arm Plate- Is the part of the swing arm that is secured directly to the rail of the pad and is the foundation of the swing arms |
| 6B | Swing Arm Spring- This add tension to the swing arm pin |
| 6C | Swing Arm Pin- This is what the resistance bands are secured with |
| 6D | Swing arm Pin Lock- This holds the swing arm in place |
| 6E | Swing Arm Hinge- This part houses the swing arm pin and spring |
| 8 | The Pad- This is the platform that the swing arms attach to the sides of, where the user may stand on for certain exercises and which folds in an up or down position depending on the desired location of the swing arms |
| 8A | Platform- The platform of the pad is the biggest portion of the pad and may be used to stand on when the pad is folded down against the floor. The back of the platform also acts as a foot rest for the user when the pad is folded up against the leg. |
| 8B | Rail- The rails run along the sides of the platform. They act as structural support for the pad and is what the swing arms are attached directly to |
| 8C | Pad Inserts/Hinges- The back of the pad has two "pegs" that fit into the foot of the back leg. They are used the secure the pad to the bench and as a hinge point for the pad and gives the pad its folding capabilities. |
| 8D | Pad Protective Strips For Rail- these plastic or rubber pieces cap the bottom of the pad to prevent the metal of the rail from scratching the floor |
| 8E | Ball Bearings- These ball bearings are sandwiched between the pad inserts and the inside of the back foot. They provide smooth and stable folding of the pad. |
| 8F | Screws For Hinges- Because of the rigidity of the pad and the back foot, the pad inserts cannot be a piece of the pad. They must be separate. Once the pad inserts are placed into the back foot, the rails of the pad can now be screwed to them |
| 8G | Hinge-The hinge runs along the platform of the pad from one rail to the other and is located more to the front of the pad. The purpose of the hinge is that when the pad is folded up against the leg, that portion of the pad can hinge forward for a more comfortable foot rest |
| 8H | Stopper For Hinge- The stopper is a piece of metal that prevents the front portion of the platform from folding too far |
| 8I | Pad Flange- This is simply an area for holes at the back of the rails of the pad. |
| 8J | Pad Flange Hole- The holes in the pad flange line up with the holes of the back foot flange for the pad locker bolt to slide into. |
| 10 | Resistance Band Housing Unit- This is designed to house multiple bands in one unit for convenience and easy handling |
| 10A | Hollow Center Tube - This center tube secures the resistance bands on the outside of it. the center of the tube slides onto the swing arm pins. |
| 10B | Outer Shell- The outer shell of the resistance band housing unit helps to secure the resistance bands in place neatly and acts as a shield for the portion of the bands wrapped around the hollow center tube. |
| 10C | Resistance Bands- The exercise bench uses a series of resistance bands from heavy duty to very lightweight |
| 10D | Clips- The clips of the resistance bands can be hooked on the bar, grip, handle or lower seat clip, depending on the exercise desired |
| 12 | Back Leg- The back leg of the bench can be folded open or closed. The top of the leg has a unique shape to allow it to fold without fitting snug against the bottom of the rail. This small gap is enough for the pad to be used when folded against the back leg. |
| 12A | Back Foot With Flange- On the top of the farthest extensions of the back foot is an area for holes. |
| 12B | Flange Hole- These holes are to be used in conjunction with the pad flange and the pad locker. |

-continued

| | |
|---|---|
| 12C | Pin Or Bolt- This is simple a way to secure the back leg to the rail and still be able to hinge for folding open or closed. |
| 12D | Leg Protective Strip- These plastic or rubber pieces are secured to the back of the back leg to prevent the metal of the back leg from scratching the floor when the leg is folded closed. |
| 12E | Protective Strips For Back Foot- These plastic or rubber pieces cap the bottom of the back foot to prevent the metal of the back foot from scratching the floor |
| 14 | Pad Locker- The purpose of the pad locker is to lock the pad in place when it is folded up or down. |
| 14A | Pad Locker Handle- The pad locker handle is used to manipulate the pad locker bolt in and out of the flange holes |
| 14B | Locker Bolt- The locker bolt fits snugly into both the back foot flange and the pad flange holes. While the bolt is moved into the holes the pad cannot move from its position. |
| 14C | Guide For The Bolt- The guide for the bolt is two rises on the top of the back foot with small protrusions that fit into grooves in the side of the bolt. This keeps the bolt lined up with the holes of the flanges |
| 14D | Guide For The bolt and Pin insert- This is another guide just like the bolt guide and works the same way. the difference is that this particular guides not only guide the bolt but also act as a hinge point for the pad locker handle |
| 14E | Pad locker Hinge Pin- This is simply a small pin that fits through the guide for the bold and pin insert and the handle of the pad licker allowing the handle to be used as needed |
| 16 | Rail- The rail is the horizontal piece held up by the legs and on which the upper and lower seats sit. |
| 16A | End Cap- The rail is capped on its end closest to the back leg |
| 16B | Flat Pin- The flat pin sits near the back of the rail and is used to secure the upper seat to the rail via a rod called the incline adjuster |
| 16C | Rail Holes- There are a series of holes in the rail to be used in conjunction with the lower seat and a stopper bolt. These holes are used to stop the lower seat from rolling. |
| 18 | Front Leg- The front leg is the front leg of the bench |
| 18A | Pin or Bolt - This secures the front leg to the rail while still allowing it to fold open or closed against the rail |
| 18B | Front Foot- The front foot is at the bottom of the front leg and stabilizes the bench. |
| 18C | Front foot caps - The front foot caps are rubber or plastic caps to protect the floor from being scratched by the foot |
| 20 | Knee Cushion- The knee cushion is located near the front of the rail. The cushion is useful for many abdominal or leg exercises |
| 20A | Knee Cushion Rail Cap- The knee cushion rail cap is secured to the front of the rail and is used to hold the knee cushion pole |
| 20B | Knee Cushion Pole- The knee cushion pole is used to hold the actual pads used for cushioning |
| 20C | Knee cushion Bolts- The knee cushion bolts secure the knee cushion rail cap to the rail |
| 22 | Shin Cushion- The shin cushion is located approximately half way down the back of the front leg. It is useful for cushioning during certain abdominal exercises |
| 22A | Shin Cushion holder- The shin cushion holder is a piece secured directly to the front leg and holds the actual pad used for cushioning |
| 22B | Shin Cushion Bolt- This bolt secures the shin cushion holder to the front leg |
| 24 | Upper Seat- The upper seat is the long portion of the working surface of the exercise bench |
| 24A | Cushion- For the upper seat |
| 24B | Upper Seat Rails With Flat Pin Receivers- the upper seat rail or frame has two flat pin receivers to be used to secure the upper seat to the lower seat |
| 24C | Cross Brace Big- This helps to hold the upper seat rails or frame together |
| 24D | Cross Brace Small- This helps to hold the upper seat rails or frame together |
| 24E | Screws For Cushion- These secure the cushion to the frame |
| 26 | Incline Adjuster- This rod is used to secure the upper seat to the rail. It is also used to adjust the angle of the upper seat |
| 26A | Flat Pin Receiver - This is a portion of the incline adjuster used with the flat pin of the rail |
| 26B | Bolt -this bolt secures the incline adjuster to the upper seat |
| 26C | Stabilizers - These keep the upper seat stable during use |
| 28 | Lower Seat- This is the small portion of the working surface of the exercise bench |
| 28A | Cushion- For the lower seat |
| 28B | Wheel Housing Unit- This is the major portion of the lower seat which everything is secured to. |
| 28C | Wheels- The 8 wheels are mounted under and inside of the wheel housing unit to allow ease of use when adjusting the angle of the upper seat cushion |
| 28D | Wheel Frames- These hold the wheels |
| 28E | Wheel Pins- These are the ball bearing axis for the wheels |

-continued

| | |
|---|---|
| 28F | Clip Holder- These are secure to either side of the wheel housing unit and is used to clip the resistance band to during certain exercises |
| 28G | Stopper Bolt- This is used to not allow the wheel housing unit to roll along the rail |
| 28H | Stopper Hole- the hole used by the stopper bolt in conjunction with the rail holes |
| 30 | Lower Seat Handles- These are on either side of the wheel housing unit and to be used during certain leg or abdominal exercises. The handles are featured to be able to unscrew enough to be folded against the lower seat, and screwed tightly again to secure it in place. |
| 30A | Handle Housing That Holds Knobbed Screw- This secures the actual handle to the wheel housing unit |
| 30B | Handle With Knobbed Screw- The knobbed end of the screw ensures that the handle cannot unscrew completely from the handles |
| 32 | Barbell- this barbell is shorter than traditional barbells because it doesn't use traditional weights. It is approximately 48 inches |
| 32A | Receiver Ring - The receiver ring fits into a groove of the barbell or other handle. It is shaped so that it cannot be removed from the bar yet spins freely. It also has a portion to allow multiple resistance bands to be attached to it. |
| 34 | Short Bar - This is a bar approximately 16 inches with a single groove and receiver ring in the middle of it |
| 36 | Triceps Rope - A traditional tricep rope with a receiver ring |
| 38 | Single Handles - Traditional handles with a receiver ring |
| 39 | Ankle Cuffs- Cushioned cuffs with a receiver ring on each |
| 40 | EZ Curl Bar - Just like the barbell just with an ergonomic shape |
| 42 | Pull-Down Bar- A traditional pull down bar with a receiver ring |
| 44 | Belt - A belt to be used for leg presses with a receiver rings on each side of it |
| 46 | Tricep Bar- A traditional tricep bar with a receiver rings |
| 48 | Close Grip Handle - A traditional close grip handle with an area to accept multiple resistance band clips |
| 50 | Accessory - The accessory can be use two different ways. The first way is as an overhead pull down device. The cloth straps can be placed between a door and a door frame. The protrusion in each strap prevents the strap from pulling through the door opening when the door is closed. There are two swing arms which resistance bands housing units can be secured to. The second way to use the accessory is as a leg exerciser. This is accomplished by clasping it around the front foot of the exercise bench and securing it via the latch and hook on the swing arms |
| 50A | Cloth Strip - These are thin enough to fit most doorways yet strong enough to handle the load stress placed upon it |
| 50B | Protrusion - This is sewn into the straps and prevents the straps from pulling through the doorway |
| 50C | Swing Arm With Hook - These are just like swing arms in every respect except they have a hook portion to it to work along with the latch |
| 50D | Latch - The latch secures the accessory around the front foot |
| 50E | Spacer - The spacer ensures proper spacing between the straps |

Having thus described a few particular embodiments of the invention, various alterations, modifications, and improvements will readily occur to those skilled in the art. Such alterations, modifications, and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

What is claimed is:

1. A multi-purpose exercise bench, comprising:

an elongated frame configured to rest on a flat floor in a stable manner, said frame comprising a longitudinally-extending member supported at each end by a respective leg, at least one of said legs comprising a ground-engaging support member extending transversely to the longitudinally-extending member for engaging the floor to support the frame in the stable manner;

a lower seat portion supported on the frame; and a resistance accessory mounted to the frame, the resistance accessory comprising:

a pad movably mounted to the ground-engaging support member of the frame to be movable between a first position and a second position;

a locking mechanism operable to lock the pad in either of the first position and the second position; and a plurality of resistance bands attached to the pad.

2. The multi-purpose exercise bench of claim 1, further comprising:

at least one resistance band housing unit mounted to the pad, the resistance band housing unit comprising a hollow outer tube and a hollow inner tube positioned within the hollow outer tube, each of the plurality of resistance bands extending around the inner tube and passing transversely through a wall of the hollow outer tube.

3. The multi-purpose exercise bench of claim 1, further comprising a pair of resistance band housing units mounted to the pad, each resistance band housing unit comprising a hollow outer tube and a hollow inner tube positioned within the hollow outer tube, each of the plurality of resistance bands extending around the inner tube and passing transversely through a wall of the hollow outer tube.

4. The multi-purpose exercise bench of claim 1, wherein said pad is pivotably mounted to said frame.

5. The multi-purpose exercise bench of claim 4, wherein a portion of said pad nests within a respective portion of said frame to pivotably interconnect said pad with said frame.

6. The multi-purpose exercise bench of claim 5, wherein said frame comprises a first flange defining a first plurality of holes, and wherein said pad comprises a second flange defining a second plurality of holes, wherein respective ones of said first and second plurality of holes may be aligned by pivoting said pad relative to said frame.

7. The multi-purpose exercise bench of claim 6, wherein said locking mechanism comprises a bolt translatable between a locked position, in which said bolt passes through aligned holes of said first and second flanges, and an unlocked position, in which said bolt does not pass through any holes of said first and second flanges.

8. The multi-purpose exercise bench of claim 7, wherein said locking mechanism comprises a toothed lever having teeth engaging teeth of the bolt, said lever being pivotable to cause translation of the bolt responsive to pivoting of the lever.

9. The multi-purpose exercise bench of claim 1, wherein said pad comprises a first portion and a second portion hingedly joined to said first portion and pivotable between a first and second position relative to said first portion, movement of said second portion relative to said first portion being limited by a stop mounted to said pad.

10. The multi-purpose exercise bench of claim 1, further comprising a backrest portion supported on the frame, the backrest portion being supported on the frame by a quick-release mechanism permitting tool-free removal of the backrest portion from the frame.

11. The multi-purpose exercise bench of claim 10, wherein the quick-release mechanism comprises at least one retaining pin supported on the frame, and at least one pin receiver supported on the backrest portion.

12. The multi-purpose exercise bench of claim 11, wherein the at least one retaining pin has a major dimension greater than a minor dimension.

13. The multi-purpose exercise bench of claim 11, wherein the at least one retaining pin has a major dimension at least two times greater than a minor dimension.

14. The multi-purpose exercise bench of claim 11, wherein the at least one retaining pin is substantially oval in cross-section.

15. The multi-purpose exercise bench of claim 11, wherein the at least one pin receiver has a generally C-shaped cross-section defining an opening for admitting passage of the at least one retaining pin.

16. The multi-purpose exercise bench of claim 1, further comprising a swing arm assembly for attaching the plurality of resistance bands to the pad, the swing arm assembly comprising:

a swing arm plate joined to the pad, the swing arm plate comprising a swing arm pin lock defining a curved path; and a swing arm pin having a first end captured by the swing arm plate, and a second end movable between an open position in which the second end is free of the curved path so that the plurality of resistance bands can be looped over the swing arm pin, and a closed position in which the second end is captured within the curved path by the swing arm plate so that the plurality of resistance bands is retained by the swing arm pin.

17. A multi-purpose exercise bench, comprising:

an elongated frame configured to rest on a flat floor in a stable manner, said frame comprising a longitudinally-extending frame rail supported at each end by a respective leg, at least one of said legs comprising a ground-engaging support member extending transversely to the longitudinally-extending frame rail for engaging the floor during use to support the frame in the stable manner;

a lower seat portion supported on the frame; and a resistance accessory mounted to the ground-engaging support member of the frame, the resistance accessory comprising:

a pad pivotably mounted to the ground-engaging support member of the frame to be pivotable, about an axis extending transversely to the longitudinally-extending frame rail, between a first position and a second position;

a locking mechanism operable to lock the pad in either of the first position and the second position; and a plurality of resistance bands attached to the pad.

18. The multi-purpose exercise bench of claim 17, further comprising:

at least one resistance band housing unit mounted to the pad.

19. The multi-purpose exercise bench of claim 18, further comprising a swing arm assembly for attaching the plurality of resistance bands to the pad, the swing arm assembly comprising:

a swing arm plate joined to the pad, the swing arm plate comprising a swing arm pin lock defining a curved path; and a swing arm pin having a first end captured by the swing arm plate, and a second end movable between an open position in which the second end is free of the curved path so that the plurality of resistance bands can be looped over the swing arm pin, and a closed position in which the second end is captured within the curved path by the swing arm plate so that the plurality of resistance bands is are retained by the swing arm pin.

20. The multi-purpose exercise bench of claim 19, the resistance band housing unit comprising a hollow outer tube and a hollow inner tube positioned within the hollow outer tube, each of the plurality of resistance bands extending around the inner tube and passing transversely through a wall of the hollow outer tube.

21. The multi-purpose exercise bench of claim 20, wherein said pad comprises a first portion and a second portion hingedly joined to said first portion and pivotable between a first and second position relative to said first portion, movement of said second portion relative to said first portion being limited by a stop mounted to said pad.

22. A multi-purpose exercise bench, comprising:

an elongated frame configured to rest on a flat floor in a stable manner;

a lower seat portion supported on the frame; and a resistance accessory mounted to the frame, the resistance accessory comprising:

a pad movably mounted to the frame to be movable between a first position and a second position;

a locking mechanism operable to lock the pad in either of the first position and the second position;

a plurality of resistance bands attached to the pad;

a swing arm assembly for attaching the plurality of resistance bands to the pad, the swing arm assembly comprising:

a swing arm plate joined to the pad, the swing arm plate comprising a swing arm pin lock defining a curved path; and a swing arm pin having a first end captured by the swing arm plate, and a second end movable between an open position in which the second end is free of the curved path so that the plurality of resistance bands can be looped over the swing arm pin, and a closed position in which the second end is captured within the curved path by the swing arm plate so that the plurality of resistance bands is retained by the swing arm pin.

* * * * *